US007067171B1

(12) United States Patent
Ito

(10) Patent No.: US 7,067,171 B1
(45) Date of Patent: Jun. 27, 2006

(54) MANUFACTURING METHOD OF ELECTRON BEAM APPARATUS AND SPACER, AND ELECTRON BEAM APPARATUS

(75) Inventor: Nobuhiro Ito, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,627

(22) Filed: Feb. 16, 2000

(30) Foreign Application Priority Data

Feb. 17, 1999 (JP) ..... 11-037958
Feb. 16, 2000 (JP) ..... 2000-037454

(51) Int. Cl.
*B05D 5/12* (2006.01)
*B05D 3/04* (2006.01)
*B05D 1/02* (2006.01)
*H01J 9/38* (2006.01)

(52) U.S. Cl. ..... 427/77; 427/64; 427/68; 427/69; 427/75; 427/78; 427/307; 427/421.1; 427/421.3; 427/284; 445/14; 445/24; 445/25

(58) Field of Classification Search ..... 427/64, 427/68, 69, 75, 77, 78, 307, 427.1, 427.3, 427/284; 445/24, 25; 313/238, 292
See application file for complete search history.

(56) References Cited

U.S. PATENT DOCUMENTS 3,843,472 A * 10/1974 Toussaint et al. ..... 428/192
4,174,523 A * 11/1979 Marlowe et al. ..... 348/796
4,904,895 A 2/1990 Tsukamoto et al.
5,066,883 A 11/1991 Yoshioka et al.
5,083,058 A * 1/1992 Nonomura et al. ..... 313/482
5,227,691 A * 7/1993 Murai et al. ..... 313/422
5,229,691 A * 7/1993 Shichao et al. ..... 315/366
5,486,126 A * 1/1996 Cathey et al. ..... 445/25
5,532,548 A * 7/1996 Spindt et al. ..... 313/422
5,569,974 A 10/1996 Morikawa et al.
5,614,781 A * 3/1997 Spindt et al. ..... 313/422
5,682,085 A 10/1997 Suzuki et al.
5,721,050 A * 2/1998 Roman et al. ..... 428/397
5,726,529 A * 3/1998 Dean et al. ..... 313/495
6,153,973 A * 11/2000 Shibata et al. ..... 313/495
6,353,280 B1 3/2002 Shibata et al. ..... 313/292
6,517,399 B1 2/2003 Ito et al. ..... 445/24

FOREIGN PATENT DOCUMENTS

EP 0 405 262 A1 1/1991
EP 0 851 458 A1 7/1998

(Continued)

OTHER PUBLICATIONS

W. P. Dyke, et al., "Field Emission," *Advances In Electronics And Electron Physics*, Academic Press Inc., vol. VIII, pp. 89-185, 1956.

(Continued)

*Primary Examiner*—Brian K Talbot
(74) *Attorney, Agent, or Firm*—Fitzpatrick, Cella, Harper & Scinto

(57) ABSTRACT

A method of manufacturing an electron beam apparatus having an airtight container with electron-emitting devices contained therein and spacers provided in the airtight container comprising the coating step of providing a film on a spacer substrate to be the spacers, and characterized in that the coating step includes the applying step of applying liquid film material by emitting from an emitting portion in a predetermined direction to a part of a surface of the spacer substrate facing the emitting portion.

22 Claims, 25 Drawing Sheets

EMIT PERPENDICULARLY
(LAID HORIZONTALLY)

EMIT IN INCLINED DIRECTION
(LAID INCLININGLY)

SIDE SURFACE AND BOTTOM
SURFACE FORMED SIMULTANEOUSLY

FOREIGN PATENT DOCUMENTS

| | | |
|---|---|---|
| JP | 57-118355 | 7/1982 |
| JP | 61-124031 | 6/1986 |
| JP | 64-31332 | 2/1989 |
| JP | 02-257551 | 10/1990 |
| JP | 03-055738 | 3/1991 |
| JP | 04-028137 | 1/1992 |
| JP | 8-180821 | 7/1996 |
| JP | 8-508846 | 9/1996 |
| JP | 10-326571 | * 12/1998 |
| JP | 11-73897 | 3/1999 |
| JP | 2000-164129 | 6/2000 |
| WO | WO 94/18694 | 8/1994 |

OTHER PUBLICATIONS

C. A. Spindt, et al., "*Physical Properties Of Thin-Film Field Emission Cathodes With Molybdenum Cones*," Journal of Applied Physics, Dec., 5249-5263, 1976.

C. A. Mead, "*Operation Of Tunnel-Emission Devices," Journal of Applied Physics*, vol. 32, pp. 646-652, Jan.-Dec., 1961.

H. Araki, et al., "*Electroforming and Electron Emission Of Carbon Thin Films*," Journal of the Vacuum Society of Japan, vol. 26, No. 1, pp. 22-29, 1983.

R. Meyer, et al., "*Recent Development On "Microtips" Display At LETI*," Technical Digest of IVMC 91, Nagahama 1991, pp. 6-9.

G. Dittmer, "*Electrical Conduction and Electron Emission Of Discontinuous Thin Films*," Thin Solid Films, 9 (1972), pp. 317-328.

M. Hartwell, et al., "*Strong Electron Emission From Patterned Tin-Indium Oxide Thin Films*," International Electron Devices Meeting, pp. 519-521, 1975.

M. I. Elinson, et al., "The Emission of Hot Electrons and The Field Emission of Electrons From Tin Oxide," Radio Engineering and Electronic Physics, Jul., 1965.

* cited by examiner

DETAIL OF SECTION A

DETAIL OF SECTION B

MANUFACTURING METHOD OF ELECTRON BEAM APPARATUS AND SPACER, AND ELECTRON BEAM APPARATUS

BACKGROUND OF THE INVENTION

1. Field of the Invention

The present invention relates to an electron beam apparatus and an image forming apparatus such as a display device as an application of such an electron beam apparatus. More particularly, the present invention relates to an electron beam apparatus and an image forming apparatus having atmospheric pressure withstanding structure, and a method of manufacturing thereof.

2. Related Background Art

Two kinds of devices, i.e., a thermoionic cathode device and a cold cathode device are conventionally known as electron-emitting devices. Known cold cathode devices include a surface conduction electron-emitting device, a field emission type device (hereinafter referred to as "FE type"), a metal/insulating layer/metal type emitting device (hereinafter referred to as ""MIM type").

As a surface conduction electron-emitting device, one disclosed in, for example, M. I. Elinson, Radio Eng. Electron Phys., 10, 1290 (1965) and others as will be described in the following are known.

A surface conduction electron-emitting device utilizes the phenomenon in which electron emission is caused by flowing electric current to a thin film formed on a substrate and having a small area so as to be in parallel to the film surface. The surface conduction electron-emitting device that has been reported includes those employing an $SnO_2$ thin film developed by Elinson et al. referred to above, those employing an Au thin film (G. Dittmer: "Thin Solid Films", 9, 317 (1972), those employing an $In_2O_3/SnO_2$ thin film (M. Hartwell and C. G. Fonstad: "IEEE Trans. ED Conf.", 519 (1975), and those employing a carbon thin film (Hisashi Araki, et al. "Shinku (Vacuum)", Vol. 26, No. 1, 22 (1983).

A typical device structure example of these surface conduction electron-emitting devices is shown in FIG. 26, which is a plan view of a device disclosed by M. Hartwell et al. referred to above. In the figure, reference numeral 3001 denotes a substrate, and reference numeral 3004 denotes a conductive thin film made of metal oxide formed by sputtering. The conductive thin film 3004 is formed to be H-shaped in plan view as illustrated. The conductive thin film 3004 is subjected to energization operation called energization forming, as will be described later, to form an electron-emitting region 3005. Intervals L and W in the figure are defined as 0.5 mm to 1 mm and 0.1 mm, respectively. For convenience of illustration, the electron-emitting region 3005 is shown as a rectangle formed in the middle of the conductive thin film 3004, but it is only a schematic illustration and the exact position and shape of the actual electron-emitting region are not faithfully expressed herein.

In the above-mentioned surface conduction electron-emitting device represented by the devices disclosed in M. Hartwell et al, it has been typically practiced to form the electron-emitting region 3005 by an energization operation called energization forming on the conductive thin film 3004 before effecting the electron emission. More specifically, in energization forming, constant dc voltage or dc voltage increasing at a very slow rate, for example, on the order of 1 v/minute, is applied to both ends of the conductive thin film 3004 for energization to locally destroy, deform, or denature the conductive thin film 3004, thus forming the electron-emitting region 3005 kept in a state of high electrical resistance. It is to be noted that a fissure is formed in a portion of the conductive thin film 3004, which is locally destroyed, deformed, or denatured. If appropriate voltage is applied to the conductive thin film 3004 after the energization forming, electron emission is carried out in the vicinity of the fissure.

Known examples of the FE type are disclosed in, for example, W. P. Dyke & W. W. Dolan, "Field emission", Advance in Electron Physics, 8, 89 (1956), C. A. Spindt, "Physical properties of thin-film field emission cathodes with molybdenum cones", J. Appl. Phys., 47, 5248 (1976), etc.

A typical device structure example of the FE type is shown in FIG. 27, which is a sectional view of a device disclosed by C. A. Spindt et al. referred above. In the figure, reference numeral 3010 denotes a substrate, reference numeral 3011 denotes emitter wiring, reference numeral 3012 denotes an emitter cone, reference numeral 3013 denotes an insulating layer, and reference numeral 3014 denotes a gate electrode. In the device, by applying the appropriate voltage between the emitter cone 3012 and the gate electrode 3014, an electric field emission from the tip of the emitter cone 3012 is caused.

As another device structure example of the FE type, different from the laminated structure shown in FIG. 27, there is also a case where an emitter and a gate electrode are disposed on a substrate substantially in parallel with the substrate plane.

Known examples of the MIM type are disclosed in, for example, C. A. Mead, "Operation of tunnel-emission Devices", J. Appl. Phys., 32, 646 (1961). A typical device structure example of the MIM type is shown in a sectional view of FIG. 28. In the figure, reference numeral 3020 denotes a substrate, reference numeral 3021 denotes a lower electrode made of metal, reference numeral 3022 denotes a thin insulating layer with the thickness of about 100 Å. Reference numeral 3023 denotes an upper electrode made of metal with the thickness of about 80 to 300 Å. In the MIM type, by applying the appropriate voltage between the upper electrode 3023 and the lower electrode 3021, an electron emission from the surface of the upper electrode 3023 is caused.

With regard to the cold cathode devices mentioned above, since electron emission can be caused at a lower temperature than the case of a thermoionic cathode device, a heater for heating is not necessary. This makes the structure simpler than that of a thermoionic cathode device, and a minute device can be formed. Further, even if a large number of devices are densely disposed, problems such as thermal melting of the substrate are less liable to occur. Further, different from the case of a thermoionic cathode device in which the response speed is low because the device operates by heating with a heater, the cold cathode device has an advantage in that the response speed is high. This leads to the active research for applying the cold cathode devices.

For example, the surface conduction electron-emitting device has an advantage in that, since it is particularly simple in structure and easily manufactured among the cold cathode devices, a large number of the surface conduction electron-emitting devices can be formed over a large area. Therefore, methods of arranging and driving a large number of such devices have been studied as disclosed by the present applicant in Japanese Patent Application Laid-open No. Sho 64-31332.

Applications of the surface conduction electron-emitting device that has been studied include an image forming apparatus such as an image display device and an image recording device, and a charging beam source. In particular, an application to the image display device that has been studied includes an image display device using a surface conduction electron-emitting device in combination with a phosphor, which emits light by being irradiated by electron beams, as disclosed by the present applicant in U.S. Pat. No. 5,066,883 and Japanese Patent Application Laid-open Nos. Hei 2-257551 and Hei 4-28137. The image display device using the combination of a surface conduction electron-emitting device and a phosphor is expected to achieve more excellent characteristics than other conventional image display devices. For example, it can be said that such an image display device is superior to a liquid crystal display device, which has been recently popularized, in that no back light is necessary because it is of a self-emission type and in that it has a larger angle of visibility.

A method of driving a large number of the FE type devices disposed is disclosed, for example, by the present applicant in U.S. Pat. No. 4,904,895. A known example of an application of the FE type to an image display device is a plane-type display device reported by R. Meyer et al. (R. Meyer: "Recent Development on Microtips Display at LETI", Tech. Digest of 4th Int. Vacuum Microelectronics Conf., Nagahama, pp. 6–9 (1991)).

An example of applying a large number of the disposed MIM-type devices to an image display device is disclosed, for example, in Japanese Patent Application Laid-open No. Hei 3-55738.

Among the image forming apparatus using electron-emitting devices described above, attention is being paid to a plane-type display device as a device to replace a cathode ray tube type display device, since it saves space and it is lightweight.

FIG. 29 is a perspective view of an example of a display panel portion of a plane-type image display device, with a part of the panel cut away to reveal the internal structure.

In the figure, reference numeral 3115 denotes a rear plate, reference numeral 3116 denotes side walls, and reference numeral 3117 denotes a face plate. The rear plate 3115, the side walls 3116, and the face plate 3117 form an envelope (airtight container) for maintaining the vacuum inside the display panel. A substrate 3111, which is fixed to the rear plate 3115, has n×m cold cathode devices 3112 formed thereon (n and m are positive integers, which are 2 or above, and are appropriately selected according to the target number of the display pixels). As shown in FIG. 29, the n×m cold cathode devices 3112 are wired by m wirings 3113 in the row direction and n wirings 3114 in the column direction. The portion formed of the substrate 3111, the cold cathode devices 3112, the row direction wirings 3113, and the column direction wirings 3114 is referred to as a multiple electron beam source. An insulating layer (not shown) between the row direction wirings 3113 and the column direction wirings 3114 is formed at least at the intersections of the two wirings to maintain electric insulation.

A fluorescent film 3118 formed of phosphors is formed on the underside of the face plate 3117 where phosphors (not shown) are individually colored into the three primary colors, i.e., red (R), green (G), and blue (B). Black portions (not shown) are provided between the respective phosphors in the three colors forming the fluorescent film 3118. Further, a metal back 3119 of Al or the like is formed on the surface of the fluorescent film 3118 on the side of the rear plate 3115.

Dx1 to Dxm, Dy1 to Dyn, and Hv are airtight electric connection terminals provided for an electric connection between the display panel and an electric circuit, which is not shown. Dx1 to Dxm are electrically connected with the row direction wirings 3113 of the multiple electron beam source, Dy1 to Dyn are electrically connected with the column direction wirings 3114 of the multiple electron beam source, and Hv is electrically connected with the metal back 3119.

The inside of the airtight container is kept at a vacuum of about 110 Pa. As the display area of the image display device becomes large, a means for preventing deformation or breakage of the rear plate 3115 and the face plate 3117, due to the air pressure difference between the inside of the airtight container and the outside, becomes more necessary. A method to do this by thickening the rear plate 3115 and the face plate 3116 not only increases the weight of the image display device, but also causes distortion and parallax of an image when viewed from an oblique angle. On the other hand, in FIG. 29, structural supports (referred to as spacers or ribs) 3120 formed of relatively thin glass plates for supporting the atmospheric pressure are provided. In this way, the distance between the substrate 3111 with the multiple electron beam source formed thereon and the face plate 3117 with the fluorescent film 3118 formed thereon is typically kept on a sub-millimeter level or is only several millimeters, with the inside of the airtight container being kept at a high vacuum as described above.

In the image display device using a display panel described above, when voltage is applied to the respective cold cathode devices 3112 through the terminals Dx1 to Dxm and Dy1 to Dyn outside the container, the respective cold cathode devices 3112 emit electrons. At the same time, high voltage of several hundred V to several kV is applied to the metal back 3119 through the terminal Hv outside the container to accelerate the emitted electrons and have them impact the inner surface of the face plate 3117. This excites the phosphors in the three colors forming the fluorescent film 3118 to emit light and display an image.

SUMMARY OF THE INVENTION

An object of the present invention is to materialize a preferable method of forming a film on minute members such as spacers provided in an airtight container of an electron beam apparatus such as the above-mentioned image display device.

In one aspect of the present invention that has been made to solve the above problem, there is provided a method of manufacturing an electron beam apparatus having an airtight container with electron-emitting devices contained therein and spacers provided in the airtight container, the method comprising the coating step of providing a film on a spacer substrate to be the spacers, characterized in that the coating step includes the applying step of applying liquid film material by emitting from an emitting portion in a predetermined direction to a part of a surface of the spacer substrate facing the emitting portion.

Here, when the spacers are to maintain the shape of the airtight container, the present invention is suitably adoptable. In particular, when the pressure inside the airtight container is lower than that outside, a force due to the air pressure difference between the inside and the outside acts on the airtight container. The spacers preferably restrict deformation of the airtight container due to that force. The present invention is particularly effective in an electron beam apparatus where the airtight container is formed of plane-type members (more specifically, a substrate having electron-emitting devices and a substrate having a phosphor, as described in the following in embodiments) facing each other. Further, the present invention is particularly effective when the size to be maintained by the spacers in the low pressure space in the airtight container (the height of the spacers, for example, the distance between the plane type members facing each other) is 1/30 or less of the main size in a direction at right angles to the size to be maintained in the low pressure space in the airtight container (for example, when the low pressure space seen from the direction of the size to be maintained is a square, the diagonal size of the square).

In the above invention, since the liquid film material is emitted in the predetermined direction, the film material can be used effectively. Further, since the liquid film material is emitted in the predetermined direction, the film material can be applied to a part of the surface facing the emitting portion. In particular, the above invention is effective in a structure where the film material is applied to a minute region.

Further, the above invention may comprise the moving step of changing the relative position of the emitting portion and the spacer substrate. The applying step may be carried out continuously as this moving step is carried out, or, the moving step and the applying step may be carried out separately by, for example, carrying out the applying step after the moving step is completed and carrying out the moving step after the applying step is completed. Having the moving step makes it possible to apply the film material to a desired region. In addition, when the film material is applied to a wide range, unevenness of the application can be decreased by combining with the moving step the applying step of applying the film material to an area smaller than the area to which the film material is to be applied finally.

In the above respective inventions, it is particularly preferable that the applying step comprises the step of emitting one drop of the liquid film material from the emitting portion. When a plurality of drops of liquid film material is simultaneously emitted from one emitting portion as in the spraying method, a problem arises that the direction of the emission of the simultaneously emitted plurality of liquid drops has to be controlled, but by adopting the structure where a plurality of liquid drops are not emitted simultaneously from one emitting portion, it becomes easy to control the direction of the emission of the liquid film material. When the spraying method is used, as described later, in order to apply the liquid film material in a predetermined direction to apply it to a part of the surface facing the emitting portion, it is preferable that a means for restricting the direction of the trajectory of the sprayed liquid film material is provided.

Further, it is preferable that the applying step is the step of emitting the liquid film material from the emitting portion by generating a bubble in the liquid film material before emission. Such a bubble can be generated by applying thermal energy. More specifically, a bubble generated by heating the liquid in an nozzle can be used. This system is known as the bubble jet system. Further, the applying step may be the step of emitting the liquid film material from the emitting portion by a piezoelectric device.

Further, as described above, the applying step may comprise the step of spraying the liquid film material. Particularly, in this case, it is preferable to restrict the direction of the trajectory of the sprayed liquid film material to emit the liquid film material in the predetermined direction. When the liquid film material is applied by spraying, since the angle of emission is likely large, in order to make the emission only in the predetermined direction, it is preferable to restrict the direction of the trajectory of the sprayed film material. More specifically, it is preferable to use a slit or a pore for restricting the direction of the trajectory of the sprayed liquid film material as the emitting portion rather than to directly use the spraying portion as the emitting portion. In this method, liquid film material, which is not emitted toward the spacer substrate from the slit or the pore by restricting the direction of the trajectory, can be recovered to be used.

Further, it is preferable that the above respective inventions further comprise the film forming step of forming the film from the applied film material. The film forming step may be the step where the applied liquid film material naturally dries, but preferably, the heating step can be adopted. Further, material contained in the applied liquid film material is not made to be the film as it is, but the film may be formed by forming bonds (for example, covalent bonds of different elements) containing at least an element contained in the applied liquid film material, or the film may be formed by decomposing bonds contained in the applied liquid film material.

Further, in the above respective inventions, the liquid film material may contain at least a metal element. The above respective inventions are suitably adoptable when an electrode (a conductive film: hereinafter also referred to as a low resistance film) is formed on the spacer substrate. When the electrode is formed, it is preferable to make the liquid film material contain a metal element such that the formed film has the desired conductivity. The metal element is not necessarily a simple metal element, but may be contained as a compound or the like.

The electrode (referred to as a low resistance film in the following embodiments) is suitably used to facilitate the movement of charge in the spacers. In particular, the electrode is suitably used to make even the electric potential of the spacers or to alleviate the charge. Further, it may control the distribution of the electric field. More specifically, the above respective inventions can be suitably used in forming an electrode provided on or in the vicinity of the surface of the spacer in contact with objects the distance between which is to be maintained by the spacer. For example, they may be used when an electrode is provided on or in the vicinity of the contacting surface with the substrate where the electron-emitting devices are provided. Further, they may be used when an electrode is provided on or in the vicinity of the contacting surface on the side of the substrate where a phosphor, which emits light by electrons emitted by the electron-emitting devices, is provided. Still further, in a structure where a control electrode such as a grid electrode is provided between the substrate where the electron-emitting devices are provided and a member facing the substrate, when the spacer is in contact with the control electrode, the above respective inventions may be used when an electrode is provided on or in the vicinity of the contacting surface with the control electrode.

Further, in the above respective inventions, the applying step may be carried out using a plurality of the emitting portions. In particular, it is preferable that the applying step is carried out using a plurality of the emitting portions with respect to one spacer substrate. In particular, it is preferable that the liquid film material is applied simultaneously from a plurality of the emitting portions. Further, the respective plurality of emitting portions may correspond to different application regions, or the liquid film material may be applied from different emitting portions to a common application region. The plurality of emitting portions are preferably provided on a common head.

Further, the present application includes the following invention as an invention of a method of manufacturing an electron beam apparatus: a method of manufacturing an electron beam apparatus, having an airtight container with electron-emitting devices contained therein and spacers provided in the airtight container, the method comprising the coating step of providing a film on a spacer substrate to be the spacers, characterized in that the coating step includes the applying step of applying liquid film material emitted drop by drop from an emitting portion to the spacer substrate. In this invention, it is preferable that the applying step is carried out using a plurality of the emitting portions for emitting the liquid film material one drop by one drop. Other than this, the present invention can be used in suitable combination with the above respective inventions.

Further, the present application includes the following invention as an invention of a method of manufacturing an electron beam apparatus. A method of manufacturing an electron beam apparatus having an airtight container with electron-emitting devices contained therein and minute members provided in the airtight container, comprising the coating step of providing a film on a minute member substrate to be the minute members, characterized in that the coating step includes the applying step of applying liquid film material by emitting from an emitting portion in a predetermined direction to a part of a surface of the minute member substrate facing the emitting portion.

The minute members referred to herein are not limited to the spacers mentioned above. The above invention is also applicable in case a film is formed on members such as airtight seal caps.

Further, the present application includes the following invention as an invention of a method of manufacturing an electron beam apparatus. A method of manufacturing an electron beam apparatus having an airtight container with electron-emitting devices contained therein and minute members provided in the airtight container, comprising the coating step of providing a film on a minute member substrate to be the minute members, characterized in that the coating step includes the applying step of applying liquid film material by emitting the liquid film material one drop by one drop from an emitting portion to the minute member substrate.

Further, the present application includes the following invention as an invention of a method of manufacturing spacers. A method of manufacturing spacers for use in an electron beam apparatus having an airtight container with electron-emitting devices contained therein and said spacers provided in the airtight container, comprising the coating step of providing a film on a spacer substrate to be the spacers, characterized in that the coating step includes the applying step of applying liquid film material by emitting from an emitting portion in a predetermined direction to a part of a surface of the spacer substrate facing the emitting portion.

Further, the present application includes the following invention as an invention of a method of manufacturing spacers. A method of manufacturing spacers for use in an electron beam apparatus having an airtight container with electron-emitting devices contained therein and said spacers provided in the airtight container, comprising the coating step of providing a film on a spacer substrate to be the spacers, characterized in that the coating step includes the applying step of applying liquid film material by emitting the liquid film material drop by drop from an emitting portion to the spacer substrate.

Further, the above respective inventions have the following as further preferable characteristics:

the liquid film material is applied simultaneously to a bottom surface and to a side surface of the spacer substrate;

the spacer substrate is pretreated in advance such that there is no substantially acute angle in section between a side surface and a bottom surface of the spacer substrate;

the pretreatment of the spacer substrate is rounding or tapering the portion between the side surface and the bottom surface;

the pretreatment of the spacer substrate is carried out such that the following relationship is satisfied:

$$(t^2+4h^2)<s^2<(t+2h)^2,$$

wherein t is the maximum value of the thickness of said spacer substrate where said film is formed, h is the height of said film, and s is the inner peripheral length of a section of said film;

the rounding of the spacer substrate is carried out such that the radius r of curvature is 1% or more of the maximum value t of the thickness of the spacer substrate where a low resistance film is formed;

the tapering of the spacer substrate is carried out by grinding;

the spacer substrate is processed using hot-draw, the hot-draw is carried out with the relationship $S_2>S_1$ being satisfied, wherein $S_1$ is the cross-section of the desired spacer substrate and $S_2$ is the cross-section of a spacer base material, with both ends of the spacer base material being fixed, the cross-section of said spacer base material being similar in shape to that of the spacer substrate, a part of said spacer base material in the longitudinal direction being heated to a temperature at or above the softening point while one end portion is fed in the direction of the heated portion at a velocity $V_1$ and the other end portion is drawn in the same direction as that of $V_1$ at a velocity $V_2$, and the relationship $S_1/S_2=V_1/V_2$ is satisfied, and the spacer base material is cooled after the hot-draw and the drawn spacer base material is cut to have the desired length;

the spacer substrate is formed of glass or ceramic;

a high resistance film is further formed on the spacers having said film formed thereon;

the high resistance film has the surface resistance value of $10^5$ [Ω/□] to $10^{12}$ [Ω/□]; or the surface resistance value of the film is 1/10 or less of that of the high resistance film and is $10^7$ [Ω/□] or less.

It is to be noted that the bottom surface of the spacer substrate means, for example, that when the electron beam apparatus is an image forming apparatus, a surface directly or indirectly fixed to the upper and lower substrates of the image forming apparatus, i.e., a face plate (hereinafter referred to as "FP") and a rear plate (hereinafter referred to as "RP"), and the side surface means a surface a normal of which has thereon the electron-emitting devices or the trajectory of the emitted electron beams. In most cases, taking into consideration the alleviation of the charge, it is preferable that a high resistance film is formed thereon, and the normal of the surface is disposed substantially in parallel with the FP and the RP.

Further, the present application comprises the following invention as an electron beam apparatus. An electron beam apparatus characterized by being obtained by a manufacturing method according to the above respective inventions.

Further, the invention of an electron beam apparatus of the present application has the following as further preferable characteristics:

the electron-emitting devices are cold cathode devices;

the electron-emitting devices are electron-emitting devices having a conductive film comprising an electron-emitting region between electrodes;

the electron-emitting devices are surface conduction electron-emitting devices;

the airtight container comprises a face plate disposed so as to face the electron-emitting devices, the face plate comprising an image forming member for forming an image by being irradiated by electrons emitted from the electron-emitting devices according to inputted signals; and the image forming member is a phosphor.

Further, an electron beam apparatus according to the present invention may have the following modes:

(1) the electron-emitting devices contained inside the airtight container form an electron source of a simple matrix-like arrangement having a plurality of electron-emitting devices wired to be a matrix by a plurality of row direction wirings and a plurality of column direction wirings;

(2) the electron-emitting devices contained inside the airtight container form an electron source arranged to be ladder-like where a plurality of electron-emitting device rows are disposed, with a plurality of electron-emitting devices disposed in parallel with one another being connected at respective both ends, and a control electrode (also referred to as a grid) disposed above the electron-emitting devices along the direction orthogonal to the wirings (referred to as the column direction) controls electrons from the electron-emitting devices.

As described above, the present invention relates to an electron beam apparatus applicable to an image forming apparatus such as a display device and the like, and particularly, in applying a film (for example, a low resistance film) to spacer members, by adopting a liquid phase forming method rather than a vapor phase forming method, sufficient electrical coupling between an end surface of a spacer member and a side surface of a spacer member and optimized control of the trajectory of the electrons are materialized.

Further, according to the present invention, an electron beam apparatus of the present invention is not limited to an image forming apparatus suitable for display and may also be used as a light emitting source as a substitute for a light-emitting diode in an optical printer formed of a photosensitive drum, a light-emitting diode, and the like, for example. Further, here, by appropriately selecting the above-mentioned plurality of row direction wirings and column direction wirings, an application not only as a linear light emitting source, but also as a two-dimensional light emitting source is possible. In this case, the image forming member is not limited to a material that directly emits light as a phosphor used in the following embodiments and a member that forms a latent image by charge of electrons may also be used.

Further, the present invention is also applicable to a case where the member irradiated by the electrons emitted from the electron source is one other than an image forming member such as a phosphor, as in the case of an electron microscope. Accordingly, an electron beam apparatus according to the present invention may be a general electron beam apparatus with the irradiated member being unspecified.

BRIEF DESCRIPTION OF THE DRAWINGS

FIG. 4 is an explanatory view of the shape in section in the vicinity of the junction portion of a spacer according to the present invention.

DETAILED DESCRIPTION OF THE PREFERRED EMBODIMENTS

First, problems solved by the structure of embodiments of the present invention described in the following are explained.

Figure 29:
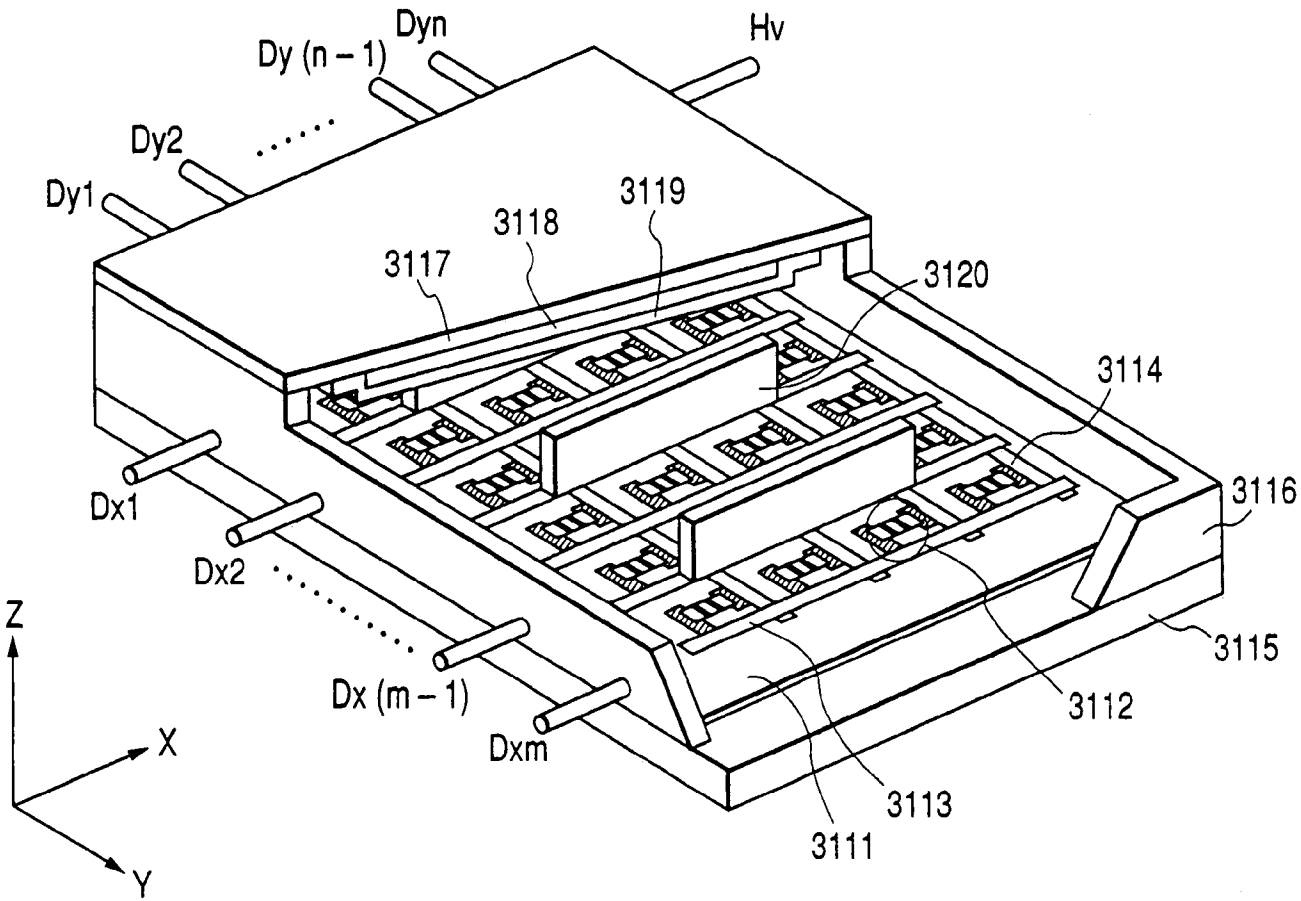
FIG. 29 PRIOR ART
FIG. 29 is a perspective view of a conventionally known plane type image display device with a part of a display panel cut away.

For example, a display panel of a conventional image display device as shown in FIG. 29 has the following problems.

First, there is a possibility that, since some electrons emitted from the vicinity of the spacer 3120 impact the spacer 3120, or, since ions ionized by the action of the emitted electrons attach to the spacer, a spacer becomes charged. Due to the charge of the spacer, electrons emitted from the cold cathode device 3112 are deflected and reach places different from the normal places on a phosphor, resulting in deformed image display in the vicinity of the spacer.

Second, since high voltage of several hundred V or above is applied (i.e., high electric field of 1 kV/mm or above) is applied between the multiple beam electron source and the face plate 3117 in order to accelerate electrons emitted from the cold cathode device 3112, there is a fear that a creeping discharge on the surface of the spacer 3120 is caused. In particular, when the spacer is charged as described above, there is a possibility that discharge is induced.

In order to solve these problems, to remove the charge by passing a minute electric current through the spacer has been proposed (Japanese Patent Application Laid-open Nos. Sho 57-118355 and Sho 61-124031). There, by forming a high resistance thin film (antistatic film) on the surface of an insulating spacer, a minute electric current passes through the surface of the spacer. The antistatic film used there is a thin film of tin oxide or mixed crystal of tin oxide and indium oxide, or a metal film.

Further, depending on the kind of the image source, in case the duty is large and the like, sometimes the decrease of the deformation of the image only by the method of removing the charge by the high resistance film is insufficient. This problem is thought to be caused by the insufficient electrical coupling between the spacer with the high resistance film and the upper and lower substrate, i.e., the face plate and the rear plate, and thus, charge concentrates in the vicinity of the junction portion. As a proposal to solve this problem, as disclosed in Japanese Patent Application Laid-open No. Hei 8-180821, there is a method of securing the electrical contact with the upper and lower substrates by forming a film from a metal such as platinum or a material having higher conductivity than that of the high resistance film with regard to the bottom surface and the range up to about 100 to 1000 μm from the side of the face plate and from the side of the rear plate.

As the method of forming such a low resistance film, sputtering and metallization by a vapor phase film forming method such as resistance heating evaporation are generally used for the reason that material composition of an even mixture thin film can be designed simply and the like. However, in production, since a vacuuming step is necessary, tact time for batch processing is necessary, the cost of the system is high, the efficiency of using the material is low, and the like, there is a big problem with regard to the production cost. Therefore, there is a need for a forming process, which can be used to form such a low resistance film simply at a low price and on a large scale.

Accordingly, a main problem to be solved by the present invention is to overcome the defects in forming the above-mentioned conventional spacers, and more specifically, to make it possible to form spacers with a low resistance film easily and at a low price without the need for a vacuum system.

Preferred embodiments of the present invention are described in the following.

In the present invention, the emission method for emitting a solution as liquid drops can be suitably used as a liquid phase forming method of a low resistance film to be applied to a spacer member.

Effects of this emission method are: (1) a vacuuming step is unnecessary; (2) the cost of the system can be reduced; (3) tact time can be reduced; and the like. More specifically, in case of the vapor phase forming method, a film after evacuation, vacuuming, film forming, or leakage to the atmosphere is in an unstable state. Since forming a film on another member in an unstable transient state may cause problems such as peeling off of the film, a change to a stable state is necessary. This is thought to relate to the structure and the surface activity of the film, and in particular, thought to relate to stabilization of desorption and absorption of water. By adopting liquid phase formation and heating to bake, which do not include a vacuuming step, going through such an unstable state can be prevented.

As further effects of the emission method, for example, since it is possible to avoid emission to a part of a film where the emission is unnecessary, the efficiency of using the material is high, and, by controlling the moving speed of the emission nozzle and a sample to be emitted and the amount of the emission, controlling the area where the film is formed, i.e., patterning, can be carried out simultaneously with the film forming step in a simple way. Thus, a patterning step using photolithography or the like can be eliminated.

Figure 7A:
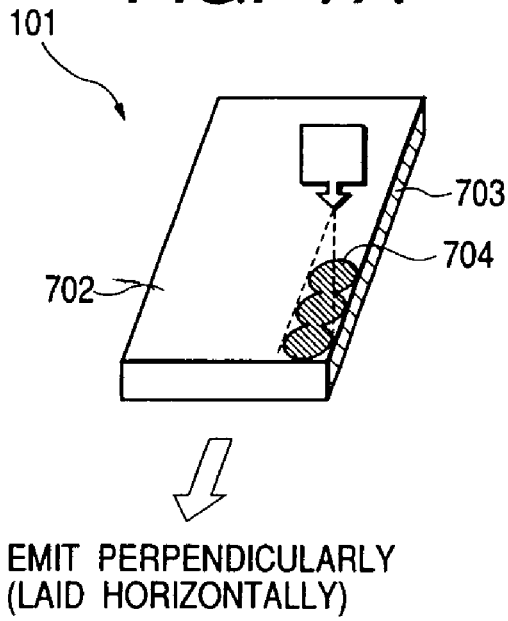
FIGS. 7A and 7B are views for explaining the direction of emission of the solution and the direction of scanning in embodiments according to the present invention.
Figure 7B:
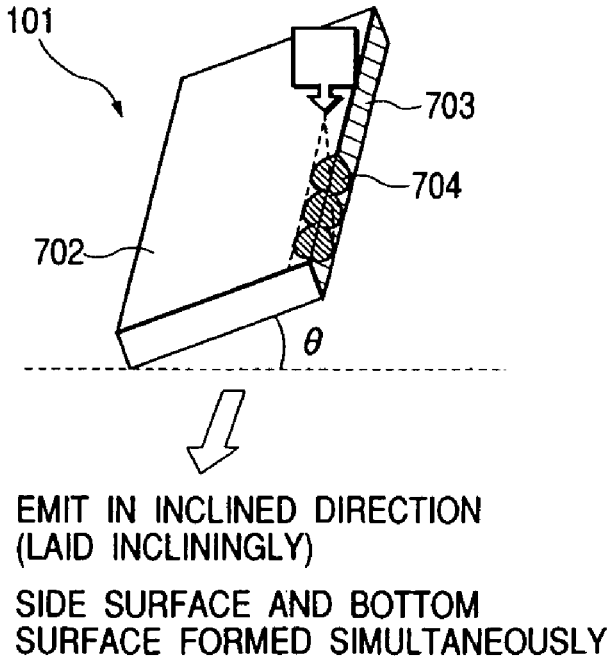

A specific example of the liquid drop applying device used here is, though any device capable of forming arbitrary liquid drops may be used, preferably, an ink-jet device capable of carrying out control in the range of about ten to twenty ng to ten to twenty μg and capable of easily forming minute liquid drops of about several dozen ng or more. As such an ink-jet device, there are an ink-jet firing device using a piezo-electric device or the like, an ink-jet firing device where a bubble is formed in a liquid by thermal energy and the liquid is emitted as liquid drops (hereinafter referred to as bubble jet type), an airbrush-type firing device where high pressure gas is used to atomize the liquid, and the like. From the viewpoint of the controllability of the liquid drop size, the method using a piezo-electric device or the method where a bubble is generated by thermal energy to emit liquid drops is preferable. Further, from the viewpoint of time-efficiency, the area where the liquid drops are emitted and the rate of coating at the interface, differently from perpendicular emission shown in FIG. 7A, as shown in FIG. 7B, it is possible to make the direction of emission of liquid drops 704 inclined with respect to a spacer substrate 101 and to simultaneously form a side surface 702 and a bottom surface 703. Further, in forming emitted liquid drops, either of the emission device and the spacer substrate as a sample to be emitted may scan, and both of them may be simultaneously scanned as necessity requires.

As the liquid drops used for forming the low resistance film, anything that can form liquid drops may be used, and there are liquids where a material for obtaining a desired resistance value is dispersed or dissolved in water or a solvent, a solution of an organic metal compound, a solution containing organic metal complex, and the like. Materials that can be selected include metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitride such as TiN, ZrN, and HfN, semiconductors such as Si and Ge, and carbon.

The film structure of the formed low resistance film may be any of the crystalline structure, amorphous structure, polycrystalline structure, and the like, and a particle film having particles dispersed therein may also be used. It is to be noted that a particle film as used herein is a film as an aggregation of a plurality of particles. Its microstructure may have particles arranged to be individually dispersed, or may have particles adjacent to one another or overlapping one another (an island-like structure is also included). The primary particle size is several Å to several thousand Å, and preferably 10 Å to 800 Å.

Further, the material of the spacer substrate may be selected from among quartz glass, glass with the impurity content such as Na is decreased, soda lime glass, a glass substrate with $SiO_2$ being formed on the surface thereof, a ceramic substrate such as alumina, and the like. In order to avoid overturning of the spacer material due to thermal stress in assembling the panel, it is preferable to select a material the coefficient of thermal expansion of which does not differ much from those of the RP and the FP. Further, particularly the shape of the spacer material is selected depending on the emission method from among plate-like, pillar-like, cylinder-like, and the like. In order to obtain the necessary shape, various kinds of methods such as sheet shaping, fiber shaping, and the like can be selected.

In order to secure the sufficient film continuity between a side surface and a bottom surface of the spacer substrate of the low resistance film, it is preferable that there is no substantially acute angle in the section at the edge of the substrate, that is, at the interface between the side surface and the bottom surface. Specific methods of attaining this include rounding or tapering the portion between the side surface and the bottom surface of the spacer substrate.

In this way, by making the shape in section of the interface between the side surface and the bottom surface of the spacer substrate a smooth continuous surface by, for example, rounding, the rate of coating of the low resistance film at the edge of the substrate, that is, at the interface between the side surface and the bottom surface, can be improved. This makes it possible to avoid cutting of the low resistance film between the bottom surface and the side surface, to obtain the electrical contact between the two surfaces, and to effectively allow, when the spacer is incorporated in an electron beam apparatus, the charge on the surface of the spacer to escape to the substrate surfaces of the FP and the RP.

Figures 1, 3A:
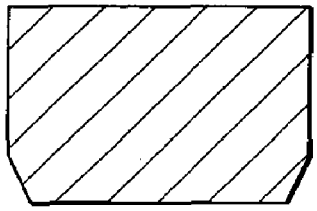
FIGS. 3A-1, 3A-2, 3A-3, 3A-4, 3B-1, 3B-2, 3B-3, and 3B-4 are views illustrating the shape in section in the vicinity of the junction portion of a spacer substrate suitably used in the present invention.
Figures 2, 3A:
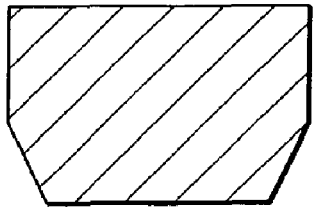
Figures 3, 3A:
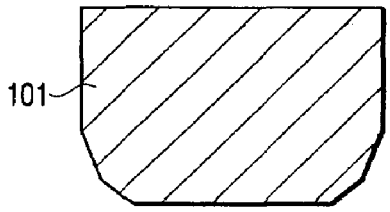
Figures 3, 3A, 4:
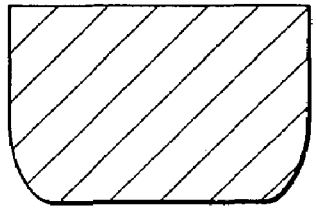
Figures 1, 3B:
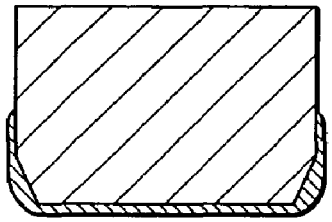
Figures 2, 3B:
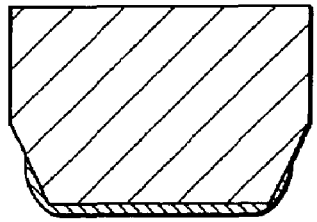
Figures 3, 3B:
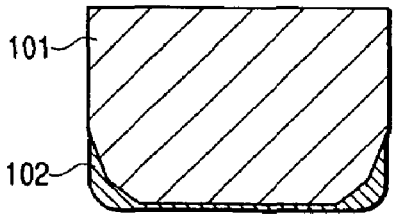
Figures 3, 3B, 4:
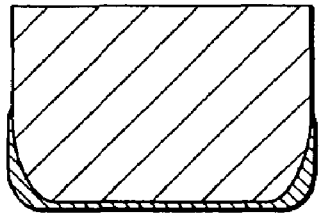
Figure 4:
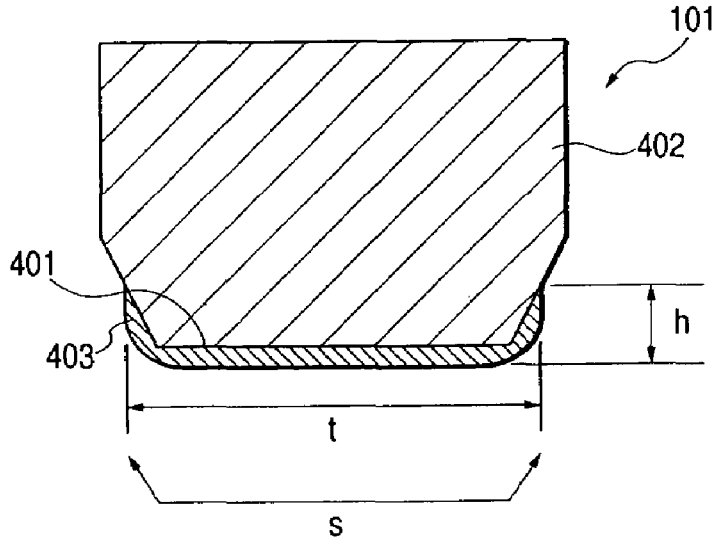

Further, the surface area of the substrate surface in the vicinity of the portion where the low resistance film is formed is preferably smaller than that of what is perpendicularly treated. Further, in order to secure the assembly accuracy, it is necessary to secure the size of the bottom surface to some extent. More specifically, as shown in FIG. 4, for example, it is preferable that the treatment is carried out such that the following relationship is satisfied:

$$(t^2+4h^2)<s^2<(t+2h)^2,$$

wherein t is the maximum value of the thickness of the spacer substrate 101 where the low resistance film 403 is formed, h is the height of the low resistance film 403, and s is the inner peripheral length of a section of the low resistance film 403.

Figure 5:
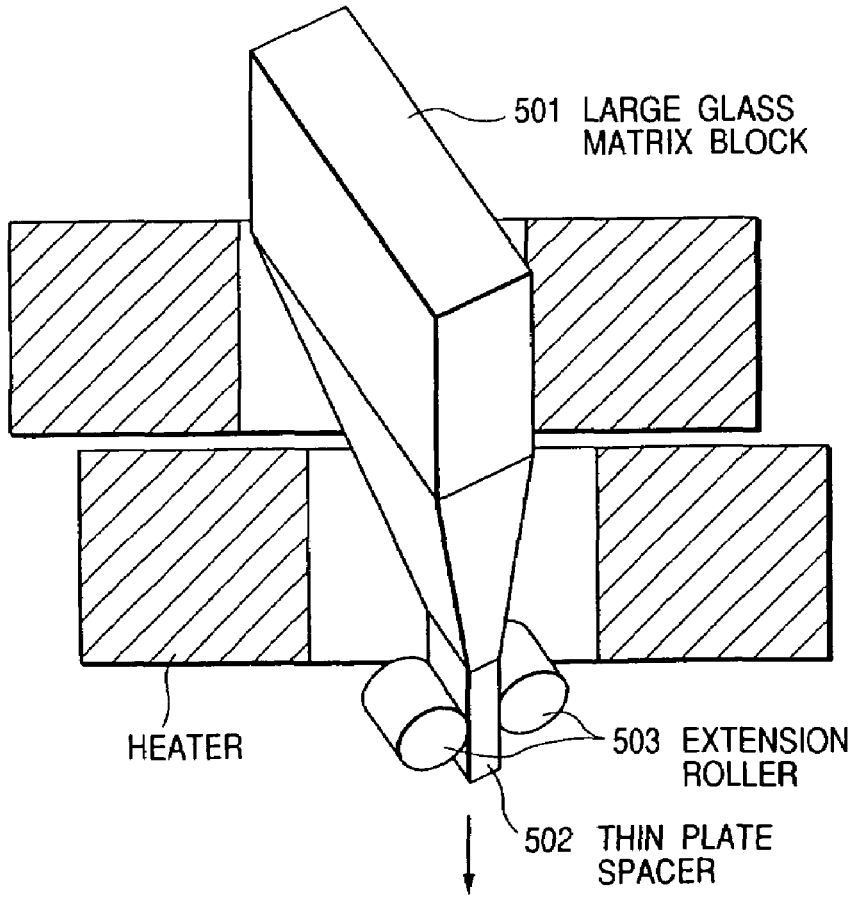
FIG. 5 is an explanatory view of a hot-draw apparatus used in processing the spacer of an embodiment according to the present invention.

As a specific method of obtaining a shape in the section that satisfies the above relationship, any means may be used so far as the continuity of the low resistance film and the electrical coupling between the bottom surface and the side surface are sufficient. As a simple method, the following hot-draw using an apparatus shown in FIG. 5 may be used.

More specifically, the hot-draw is carried out with the relationship $S_2>S_1$ being satisfied wherein $S_1$ is the cross-section of the desired spacer substrate and $S_2$ is the cross-section of a spacer base material 501, with both ends of the spacer base material 501 being fixed, the cross-section of the spacer base material being similar in shape to that of the spacer substrate, a part of the spacer base material 501 in the longitudinal direction being heated to a temperature at or above the softening point while one end portion is fed in the direction of the heated portion at velocity $V_1$ and the other end portion is drawn in the same direction as that of $V_1$ at velocity $V_2$, and the relationship $S_1/S_2=V_1/V_2$ being satisfied. Here, the heating temperature depends on the kind of the base material and the processed shape, and is normally about 500 to 700° C. After this, the spacer base material is cooled. By cutting the drawn spacer base material to have the desired length, a spacer substrate having the desired shape in the section can be obtained.

As the after-treatment of the edge of the substrate perpendicularly cut or shaved, rounding or tapering may be carried out. Here, as a specific means, sandblasting, laser scribing, water blasting, scribing cut, grinding, chemical etching using fluoric acid or the like may be used.

With regard to the range of the radius of curvature of the rounding of the substrate edge, a sufficient continuous surface can be formed when the radius of curvature is ½ or less of the substrate thickness, but empirically, preferably, by making the radius of curvature 1/100 or more of the maximum value t (see FIG. 4) of the thickness of the spacer substrate where the low resistance film is formed, the continuity of the low resistance film and the assembly accuracy can be satisfied.

Inherently, according to the emission method, since it has the patterning function, separate patterning is not necessary. However, when short circuit to wirings or the shape of a protrusion in the vicinity of the substrate edge is the cause of the discharge or the like, as necessity requires, it is also effective to make a portion on which the low resistance film is partially formed. Specific means for attaining this include, but are not limited to, an etching process accommodating the low resistance film, removing using laser repairing, patterning using photolithography or a lift-off process, and partial expansion of a coating liquid using a mask.

Further, by additionally applying a high resistance film on the spacer having the low resistance film formed thereon by the emission method, the charge on the surface of the spacer is suppressed, and, as a result, a sufficient image without a shift of emission can be obtained. More preferably, by making the high resistance film with a surface resistance of $10^5$ [Ω/□] to $10^{12}$ [Ω/□], charge, current consumption between the upper and lower substrates, and heat generation can be suppressed. Further, the surface resistance value of the low resistance film is, for the purpose of making sufficient its electrical coupling to the upper and lower substrates, preferably, 1/10 or less of that of the high resistance film and is $10^7$ [Ω/□] or less.

Further, the electron-emitting devices used in the present invention are preferably cold cathode devices, and more preferably, surface conduction electron-emitting devices such as electron-emitting devices having a conductive film comprising an electron-emitting region between electrodes, since they are simple in structure and can attain high brightness.

Further, by making the FP comprise an image forming member for forming an image by being irradiated by electrons emitted from the electron-emitting devices according to inputted signals, the electron beam apparatus according to the present invention can be an image forming apparatus such as a display device. As the image forming member, various materials can be used to form a latent image from the viewpoint of image recording, but by forming it of a phosphor, dynamic images can be recorded and displayed at a low cost.

Outline of Image Display Device

Next, a structure of and a method of manufacturing a display panel of an image display device are described showing a specific example.

Figure 9:
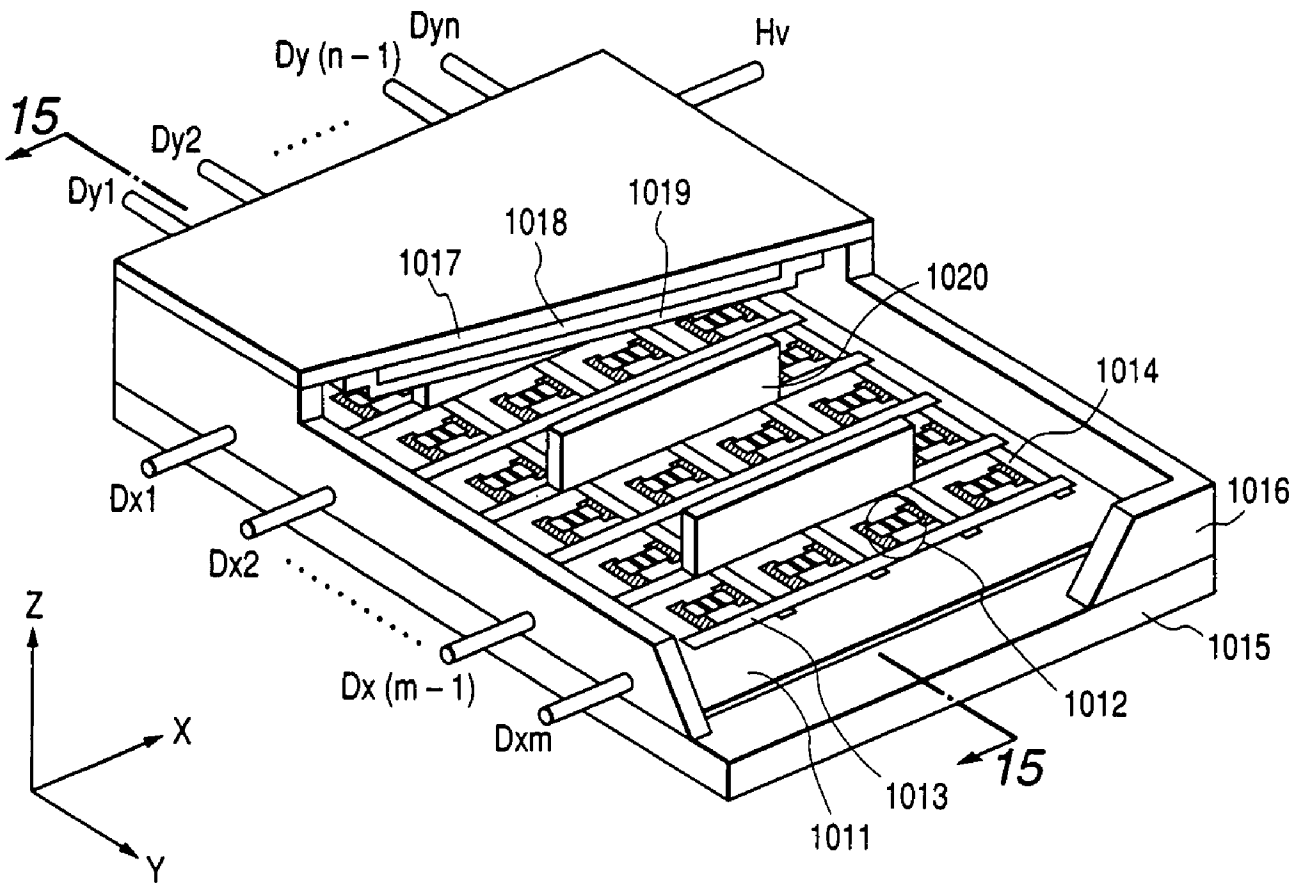
FIG. 9 is a perspective view of an image display device as an embodiment of the present invention, with a part of a display panel cut away.

FIG. 9 is a perspective view of a display panel used in an embodiment with a part of the panel cut away to reveal the internal structure.

In the figure, reference numeral 1015 denotes a rear plate, reference numeral 1016 denotes side walls, and reference numeral 1017 denotes a face plate. The components 1015 to 1017 form an airtight container for maintaining the vacuum inside the display panel. In assembling the airtight container, it is necessary to seal the junction portions between the respective members to retain sufficient strength and airtightness. The seal is attained by, for example, applying frit glass on the junction portions and carrying out baking in the atmosphere or a nitrogen atmosphere at 400 to 500° C. for ten minutes or more. A method of vacuuming the inside of the airtight container is described later. Since the inside of the airtight container is kept at a vacuum of about $10^{-4}$ Pa, for the purpose of preventing breakage of the airtight container due to the atmospheric pressure, a sudden impact, or the like, spacers 1020 as structural bodies for withstanding the atmospheric pressure are provided.

Next, an electron source substrate, which can be used for an image forming apparatus according to the present invention, is described. An electron source substrate used for an image forming apparatus according to the present invention is formed by arranging a plurality of electron-emitting devices on a substrate.

Methods of arranging electron-emitting devices include a ladder-like arrangement where electron-emitting devices are disposed in parallel with one another, with the respective both ends thereof being connected through wirings (hereinafter referred to as a ladder-like arranged electron source substrate), and a simple matrix-like arrangement where a pair of device electrodes of the respective electron-emitting devices are connected to X direction wirings and Y direction wirings, respectively (hereinafter referred to as a matrix-like arranged electron source substrate). It is to be noted that an image forming apparatus having a ladder-like arranged electron source substrate requires a control electrode (grid electrode), which is an electrode for controlling the trajectory of electrons from the electron-emitting devices.

A substrate 1011, which is fixed to the rear plate 1015, has n×m electron-emitting devices 1012 formed thereon (n and m are positive integers, which are 2 or above, and are appropriately selected according to the target number of the display pixels. For example, in a display device the target of which is a display for a high-definition television, it is preferable that n≧3000 and m≧1000 are set.) The n×m electron-emitting devices are wired to be simple matrix-like by m wirings 1013 in the row direction and n wirings 1014 in the column direction. The portion formed of the above components 1011 to 1014 is referred to as a multiple electron beam source.

The material, shape, or method of manufacturing of the electron-emitting devices of the multiple electron beam source used in the image display device according to the present invention is not limited as far as the electron-emitting devices in the electron source are wired to be simple matrix-like or wired to be ladder-like.

Therefore, for example, cold cathode devices such as surface conduction electron-emitting devices, the FE type devices, or the MIM type devices may be used.

Next, the structure of the multiple electron beam source where surface conduction electron-emitting devices (described later) as the electron-emitting devices are arranged on a substrate and wired to be simple matrix-like is described.

Figure 10:
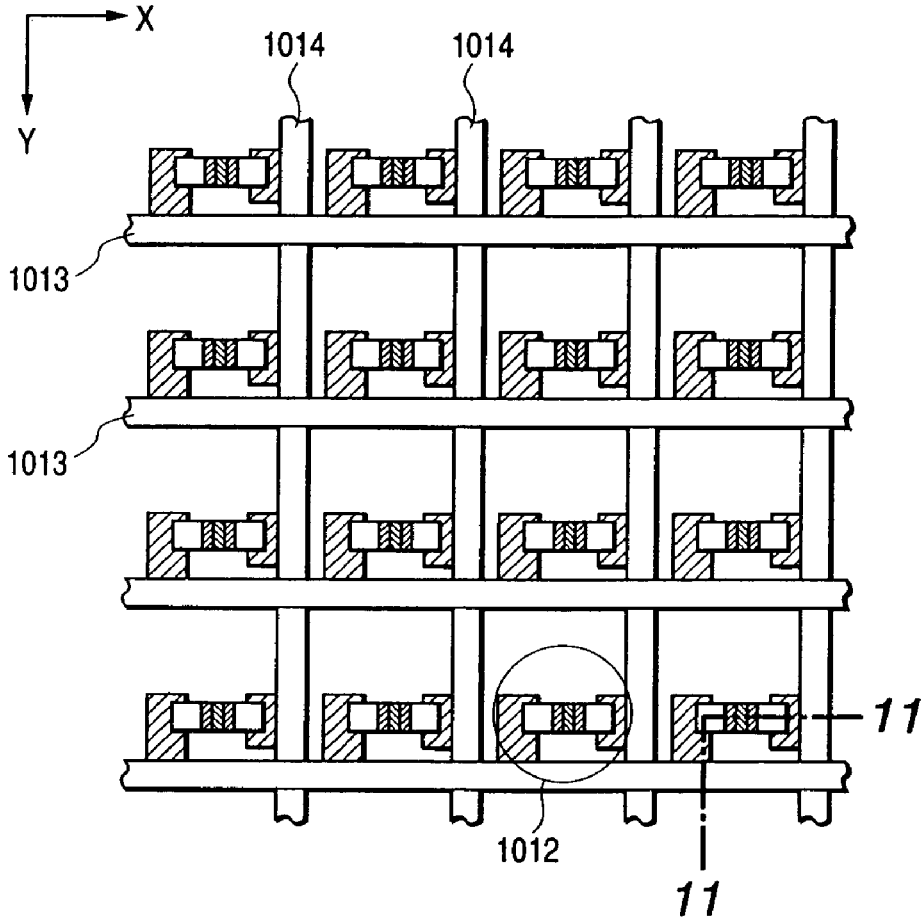
FIG. 10 is a plan view showing a part of a substrate of a multiple electron beam source used in the embodiment.
Figure 11:
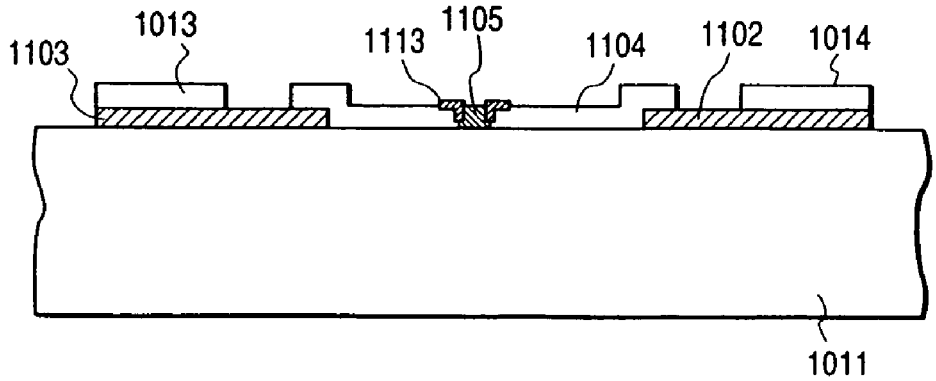
FIG. 11 is a sectional view of the multiple electron beam source substrate taken along the line 11—11 in FIG. 10.

FIG. 10 shows a plan view of a multiple electron beam source used in the display panel of FIG. 9. Surface conduction electron-emitting devices similar to those shown in FIG. 16 (described later) are arranged on the substrate 1011, and these devices are wired to be simple matrix-like by the row direction wirings 1013 and the column direction wirings 1014. An insulating layer (not shown) is formed between electrodes at the intersections of the row direction wirings 1013 and the column direction wirings 1014 to maintain electric insulation. FIG. 11 shows a sectional view taken along the line 11—11 in FIG. 10.

It is to be noted that the multiple electron source structured in this way is manufactured by forming in advance the row direction wirings 1013, the column direction wirings 1014, the insulating layer (not shown) between electrodes, and device electrodes and conductive thin films of the surface conduction electron-emitting devices on the substrate, and then supplying power to the respective devices through the row direction wirings 1013 and the column direction wirings 1014 to carry out the energization forming operation (described later) and the energization activation operation (described later).

In the present embodiment, the substrate 1011 of the multiple electron beam source is structured to be fixed to the rear plate 1015 of the airtight container. However, if the substrate 1011 of the substrate of the multiple electron beam source has sufficient strength, the substrate 1011 itself of the multiple electron beam source may be used as the rear plate of the airtight container.

Figure 12:
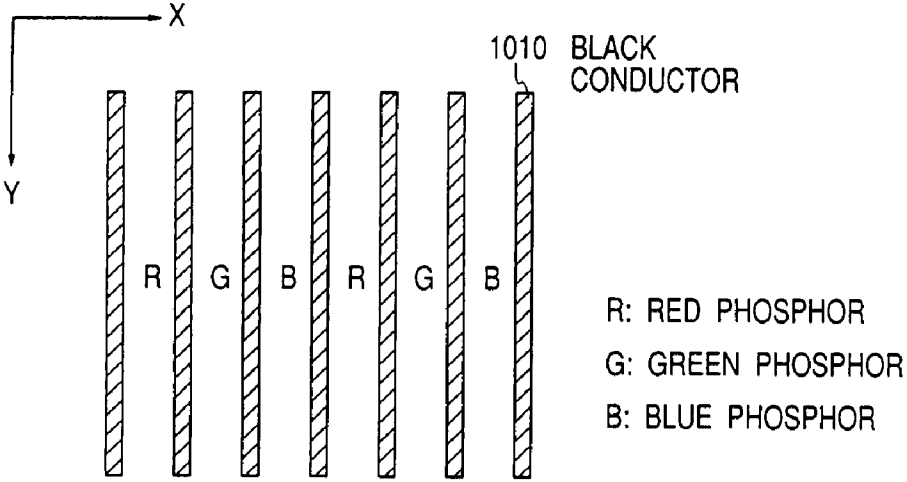
FIG. 12 is a view showing an example of the arrangement of phosphors on a face plate of a display panel.

Further, a fluorescent film 1018 is formed on the underside of the face plate 1017. Since the present embodiment refers a color display device, the fluorescent film 1018 is formed of phosphors in the three primary colors, i.e., red, green, and blue used in the field of CRTs. The phosphors in the colors are colored in a stripe-like manner as shown in FIG. 12, for example, and black conductors 1010 are provided between the strips of the phosphors. The purposes of providing the black conductors 1010 are to avoid a shift in the displayed colors even the irradiation positions of the electron beams shift a little, to avoid lowering of the displayed contrast by avoiding reflection of outside light, to avoid charge-up of the fluorescent film due to the electron beams, and the like. Graphite is used as the main component of the black conductors 1010, but any other material that is suitable for the above purposes may also be used.

Figure 13:
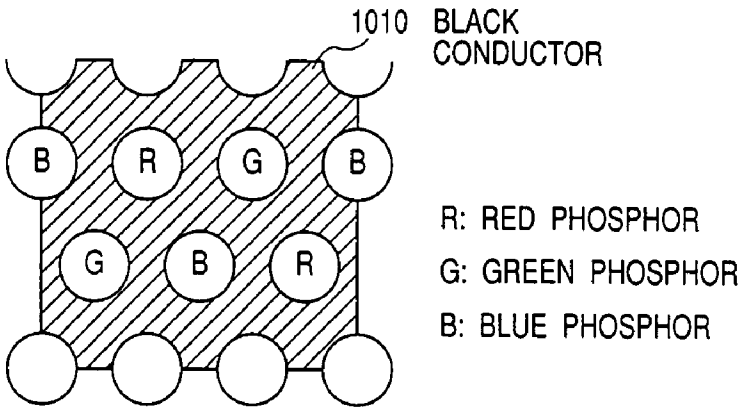
FIG. 13 is a view showing another example of the arrangement of phosphors on the face plate of the display panel.

Further, the way to color the phosphors in the three primary colors is not limited to the above-mentioned stripe-like arrangement as shown in FIG. 12, and a delta-like arrangement as shown in FIG. 13 or other arrangements may also be used.

It is to be noted that, when a monochrome display panel is formed, a monochrome phosphor material is used as the fluorescent film 1018, and the black conductor material is not necessarily required to be used. Further, a metal back 1019, which is well known in the field of CRTs, is formed on the surface of the fluorescent film 1018 on the side of the rear plate. The purposes of providing the metal back 1019 are to improve the rate of light utilization by mirror reflection of a part of light emitted from the fluorescent film 1018, to protect the fluorescent film 1018 against impact of negative ions, to make it act as an electrode for applying the electron beam accelerating voltage, to make the fluorescent film 1018 act as a conductive path of excited electrons, and the like. The metal back 1019 is formed by, after forming the fluorescent film 1018 on the face plate substrate 1017, smoothing the surface of the fluorescent film and vacuum evaporation of Al thereon. It is to be noted that, when a phosphor material for low voltage is used as the fluorescent film 1018, the metal back 1019 is not used.

Further, though not used in the present embodiment, for the purpose of applying the accelerating voltage or improving the conductivity of the fluorescent film, a transparent electrode made of ITO, for example, may be provided between the face plate substrate 1017 and the fluorescent film 1018.

Figure 15:
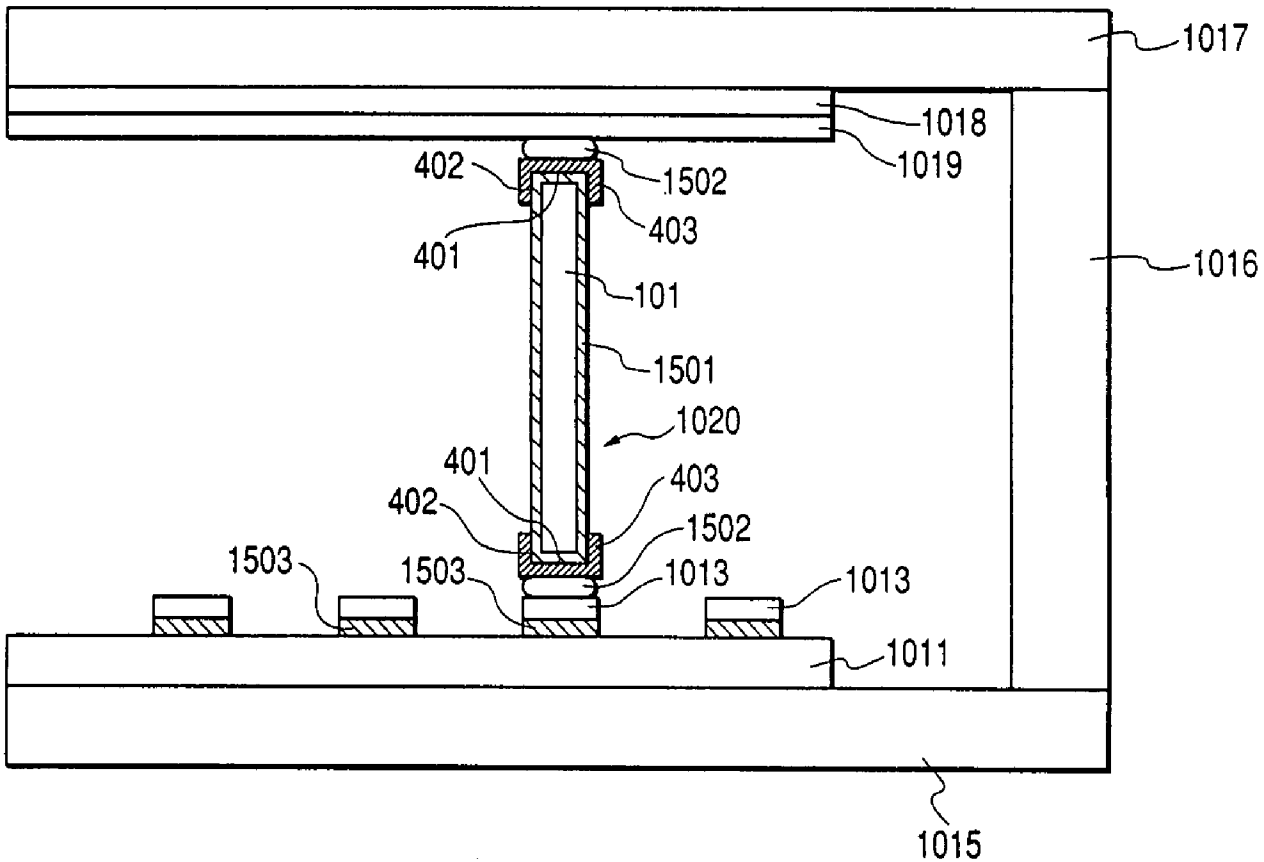
FIG. 15 is a sectional view of the display panel taken along the line 15—15 in FIG. 9.

FIG. 15 is a schematic sectional view taken along the line 15—15 in FIG. 9, and the respective reference numerals corresponds to those in FIG. 9. A spacer 1020 is a member formed by forming an antistatic high resistance film 1501 on the surface of the spacer substrate 1011 and by forming the low resistance films 403 on contacting surfaces 401 of the spacer facing the inside of the face plate 1017 (such as the metal back 1019) and the surface of the substrate 1011 (the row direction wirings 1013 or the column direction wirings 1014) and on side surfaces 402 that are in contact with the contacting surfaces 401. A necessary number of such spacers are disposed at necessary intervals for attaining the above object, and are fixed to the inside of the face plate 1017 and to the surface of the substrate 1011 with joint material 1502.

The high resistance film 1501 is formed on the surface of the spacer substrate 101 at least on the side exposed to the vacuum in the airtight container, and is electrically connected through the low resistance films 403 on the spacer 1020 and the joint materials 1502 to the inside of the face plate 1017 (such as the metal back 1019) and to the surface of the substrate 1011 (the row direction wirings 1013 or the column direction wirings 1014).

In the embodiment presently described, the shape of the spacer 1020 is thin plate-like, and it is disposed so as to be in parallel with the row direction wirings 1013 and is electrically connected with the row direction wirings 1013.

The spacer 1020 is required to have enough insulation to withstand the high voltage applied between the row direction wirings 1013 and the column direction wirings 1014 on the substrate 1011 and the metal back 1019 inside the face plate 1017, and to have enough conductivity to prevent charge on the surface of the spacer 1020.

As the spacer substrate 101, as mentioned in the above, quartz glass, glass with the impurity content such as Na being lowered, soda lime glass, a ceramic member such as alumina, or the like is used. It is to be noted that the coefficient of thermal expansion of the spacer substrate 101 is preferably close to that of the materials for forming the airtight container and the substrate 1011.

Electric current of accelerating voltage Va applied to the face plate 1017 (such as the metal back 1019) on the higher potential side divided by the resistance value Rs of the antistatic high resistance film 1501 flows through the high resistance film 1501 forming the spacer 1020. Therefore, the desirable range of the resistance value Rs of the spacer is set from the viewpoint of preventing charge and power consumption. From the viewpoint of preventing charge, it is preferable that the surface resistance is $10^{12}$ Ω/□ or less. In order to obtain sufficient antistatic effects, it is more preferable that the surface resistance is $10^{11}$ Ω/□ or less. The lower limit of the surface resistance depends on the shape of the spacer and the voltage applied between spacers, but is preferably $10^{5}$ Ω/□ or more.

The thickness t of the high resistance film 1501 formed on the spacer substrate 101 formed of an insulating material is preferably 10 nm to 1 μm. It depends on the surface energy of the material, the adhesion to the substrate, and the temperature of the substrate, but generally, a thin film the thickness of which is 10 nm or less is formed to be island-like, and the resistance is unstable and has poor repeatability. On the other hand, if the film thickness t is 1 μm or more, the enlarged film stress increases the possibility of peeling off of the film, and, since the film forming time becomes longer, the productivity is low. Accordingly, it is preferable that the film thickness is 50 to 500 nm. Since the surface resistance R/□ is ρ/t, and the preferable ranges of R/□ and of t are as mentioned above, the resistivity ρ of the high resistance film 1501 is preferably 0.1 Ωcm to $10^{8}$ Ωm. Further, in order to materialize a more preferable range of the surface resistance and the film thickness, ρ is preferably $10^{2}$ to $10^{6}$ Ωcm.

As described above, the temperature of the spacer rises by allowing electric current to flow through the high resistance film 1501 formed on the spacer, or by generation of heat of the display as a whole in operation. If the temperature coefficient of resistance of the high resistance film 1501 is a large negative value, as the temperature rises, the resistance value decreases, electric current through the spacer increases, and a further temperature rise is caused. The electric current keeps increasing until it exceeds the limit of the power source. The value of the temperature coefficient of resistance at which such runaway of the electric current is caused is, empirically, a negative value the absolute value of which is 1% or more. Therefore, the temperature coefficient of resistance of the high resistance film (antistatic film) 1501 is preferably less than −1%.

As the material of the high resistance film 1501 having antistatic characteristics, for example, a metal oxide can be used. Among metal oxides, oxides of chromium, nickel, and copper are preferable materials. The reason is thought to be that the secondary electron emission efficiencies of these oxides are relatively small, and the possibility of charging is small even if electrons emitted from the electron-emitting devices 1012 impact the spacer 1020. Other than metal oxides, carbon is also a preferable material, because its secondary electron emission efficiency is small. In particular, the resistance of amorphous carbon is high, and thus, when it is used, the spacer resistance is easily controlled to have a desired value.

Other than the above, as the material of the high resistance film 1501 having antistatic characteristics, nitrides of aluminum and transition metal alloys are preferable materials, because the resistance value thereof can be controlled in a wide range from a highly conductive material to an insulator by adjusting the composition of the transition metal. Further, the change in the resistance value is small during the manufacturing process of the display device described later, and thus, these materials are stable. In addition, their temperature coefficient of resistance is less than −1%, and thus, they are practically easy to use. The transition metal elements include Ti, Cr, and Ta.

The alloy nitride film is formed on an insulating member by a thin film-forming means such as sputtering, reactive sputtering in a nitrogen atmosphere, electron beam evaporation, ion plating, or ion assisted evaporation. A metal oxide film can be formed in a similar thin film-forming means, but in this case, oxygen gas is used instead of the nitrogen gas. Other than this, the metal oxide film can be formed also by CVD or by applying an alkoxide. The carbon film is formed by sputtering, CVD, or plasma CVD. In particular, when amorphous carbon is formed, the atmosphere during the film formation contains hydrogen, or hydrocarbon gas is used as the film-forming gas.

The low resistance films 403 forming the spacer 1020 are provided to electrically couple the high resistance film 1501 to the face plate 1017 (such as the metal back 1019) on the higher potential side and to the substrate 1011 (such as the wirings 1013 and 1014) on the lower potential side. In the following, they are also referred to as intermediate electrode layers (intermediate layer). The intermediate electrode layers (intermediate layer) may have at least one of the following plurality of functions.

(1) To Electrically Connect the High Resistance Film 1501 with the Face Plate 1017 and the Substrate 1011.

As described above, the high resistance film 1501 is provided to prevent charging on the surface of the spacer 1020. However, if the high resistance film 1501 is connected with the face plate 1017 (such as the metal back 1019) and the substrate 1011 (such as the wirings 1013 and 1014) directly or through the joint materials 1502, large contact resistance may generate at the interface of the connecting portion and the charge generated on the surface of the spacer may not be promptly removed. In order to avoid this, the low resistance intermediate layer is provided on the contacting surfaces 401 of the spacer 1020 in contact with the face plate 1017, the substrate 1011, and the joint materials 1502 and on the side surfaces 402.

(2) To Make Even the Potential Distribution of the High Resistance Film 1501.

Electrons emitted by the electron-emitting device 1012 have an electron trajectory according to the potential distribution formed between the face plate 1017 and the substrate 1011. In order to avoid turbulence in the electron trajectory in the vicinity of the spacer 1020, it is necessary to control the potential distribution of the high resistance film 1501 over the whole area. If the high resistance film 1501 is connected with the face plate 1017 (such as the metal back 1019) and the substrate 1011 (such as the wirings 1013 and 1014) directly or through the joint materials 1502, due to the contact resistance at the interface of the connecting portion, unevenness in the connected state may generate to shift the potential distribution of the high resistance film 1501 from the desired value. In order to avoid this, the low resistance intermediate layers 403 are provided over the full length area of the spacer end portions (the contacting surfaces 401 and the side surfaces 402) of the spacer 1020 in contact with the face plate 1017 and the substrate 1011, and by applying desired potential to this intermediate layer portion, the potential of the high resistance film 1501 as a whole can be controlled.

(3) To Control the Trajectory of the Emitted Electrons.

Electrons emitted by the electron-emitting device 1012 have an electron trajectory according to the potential distribution formed between the face plate 1017 and the substrate 1011. With regard to electrons emitted from an electron-emitting device in the vicinity of the spacer, a restriction accompanying the provision of the spacer (change in the position of the wirings and of the device and the like) may be caused. In such a case, in order to form an image without distortion and unevenness, it is necessary to control the trajectory of the emitted electrons to irradiate the electrons at desired positions on the face plate 1017. By providing the low resistance intermediate layers on the side surfaces 402 of the faces in contact with the face plate 1017 and the substrate 1011, the electric potential distribution in the vicinity of the spacer 1020 may have the desired characteristics to make it possible to control the trajectory of the emitted electrons.

The low resistance films 403 may be selected from what contains a material having the resistance value that is smaller than that of the high resistance film 1501 by one digit or more, and is appropriately selected from metals such as Ni, Cr, Au, Mo, W, Pt, Ti, Al, Cu, Pd, alloys thereof, printed conductors formed of a metal or a metal oxide such as Pd, Ag, Au, $RuO_2$, Pd—Ag and of glass or the like, transparent conductors such as $In_2O_3$—$SnO_2$, semiconductor materials such as polysilicon, and the like.

The joint materials 1502 are required to be conductive so that the spacer 1020 is electrically connected with the row direction wirings 1013 and the metal back 1019. Therefore, frit glass with conductive adhesive, metal particles, or conductive filler added thereto is preferable.

Dx1 to Dxm, Dy1 to Dyn, and Hv are airtight electric connection terminals provided for an electric connection between the display panel and an electric circuit, which is not shown. DX1 to Dxm are electrically connected with the row direction wirings 1013 of the multiple electron beam source, Dy1 to Dyn are electrically connected with the column direction wirings 1014 of the multiple electron beam source, and Hv is electrically connected with the metal back 1019.

In order to evacuate the inside of the airtight container, after the airtight container is assembled, an exhaust pipe, which is not shown, is connected with a vacuum pump to vacuum the inside of the airtight container to about $10^{-5}$ Pa. After that, the exhaust pipe is sealed. In order to keep the vacuum in the airtight container, a getter film (not shown) is formed at a predetermined position inside the airtight container just before the sealing or after the sealing. A getter film is a film formed by heating with a heater or by high-frequency heating a getter material the main component of which is Ba, for example, and by evaporation. By the absorbing action of the getter film, the vacuum inside the airtight container is maintained at about $10^{-3}$ Pa to $10^{-5}$ Pa.

In the image display device using the display panel described above, when voltage is applied to the respective electron-emitting devices 1012 through the terminals Dx1 to Dxm and Dy1 to Dyn outside the container, the respective electron-emitting devices 1012 emit electrons. At the same time, high voltage of several hundred V to several kV is applied to the metal back 1019 through the terminal Hv outside the container to accelerate the emitted electrons and have them impact the inner surface of the face plate 1017. This makes the phosphors in the three colors forming the fluorescent film 1018 excited to emit light and display an image.

Normally, the voltage applied to the surface conduction electron-emitting devices 1012 which are cold cathode devices, is about 12 to 16V, the distance d between the metal back 1019 and the surface conduction electron-emitting devices 1012 is about 0.1 mm to 8 mm, and the voltage between the metal back 1019 and the surface conduction electron-emitting devices 1012 is about 0.1 kV to 10 kV.

The basic structure and the method of manufacturing the display panel as an embodiment of the present invention and the outline of the image display device are described above.

Next, a method of manufacturing the multiple electron beam source used in the above-mentioned display panel is described. As the multiple electron beam source used in the image display device of the present invention, an electron source where cold cathode devices are wired to form simple matrix-wiring may be used. There is no limitation with regard to the material, the shape, and the method of manufacturing of the cold cathode devices. Therefore, for example, cold cathode devices such as surface conduction electron-emitting devices, the FE type devices, or the MIM type devices may be used.

However, it is to be noted that under the present circumstances where a display device, which has a large display screen and which is low-priced is needed, among these cold cathode devices, surface conduction electron-emitting devices are particularly preferable. More specifically, in the FE type devices, since the relative positions and the shapes of an emitter cone and a gate electrode greatly influence the electron emission characteristics, highly accurate manufacturing technology is necessary, which is a disadvantageous factor for accomplishing larger area and lower manufacturing cost. In the MIM type devices, it is necessary to make small and even the film thickness of an insulating layer and of an upper electrode, which is also a disadvantageous factor for obtaining a larger area and a lower manufacturing cost. On the other hand, with regard to surface conduction electron-emitting devices, since the manufacturing method is relatively simple, larger area and lower manufacturing cost are easily achieved. Further, the inventors of the present invention have found that, among surface conduction electron-emitting devices, those the electron emitting regions of which, or portions in the vicinity of which, are formed of a particle film are particularly excellent in the electron emission characteristics. In addition, manufacturing thereof can be easily carried out. It follows that, therefore, surface conduction electron-emitting devices are preferably used in a multiple electron beam source of an image display that has a large, bright screen. Accordingly, in the display panel of the above embodiment, surface conduction electron-emitting devices the electron emitting regions of which, or portions in the vicinity of which, are formed of a particle film are used.

First, the basic structure, the method of manufacturing, and the characteristics of a preferable surface conduction electron-emitting device are described, and then, the structure of a multiple electron beam source where a number of devices are wired to form simple matrix-wiring is described.

Preferable Device Structure and Method of Manufacturing of Surface Conduction Electron-Emitting Device The plane-type and the step-type are representative structures of surface conduction electron-emitting devices.

Plane-Type Surface Conduction Electron-Emitting Device

Figure 16A:
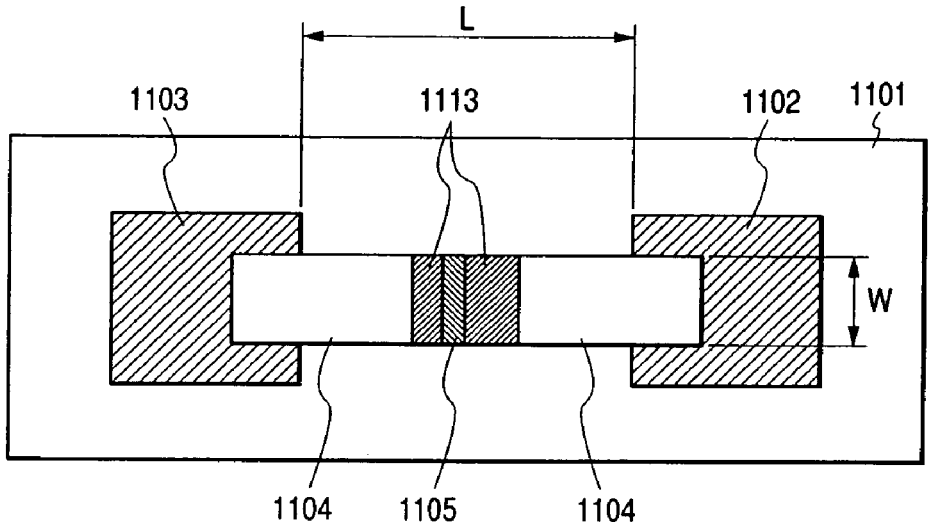
FIGS. 16A and 16B are a plan view and a sectional view, respectively, of a plane type surface conduction electron-emitting device used in the embodiments.
Figure 16B:
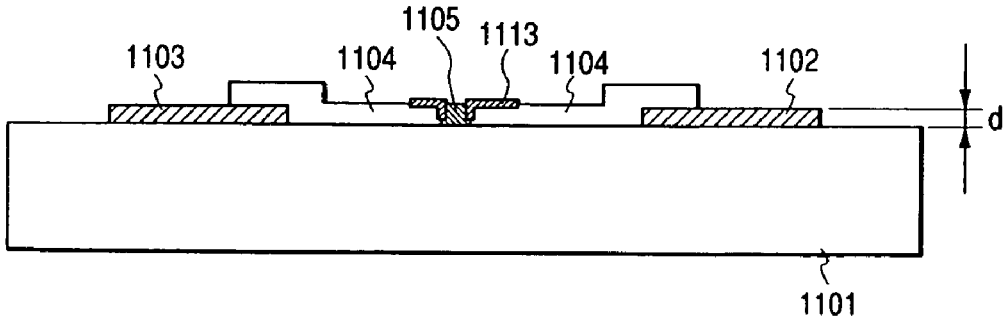

First, the device structure and the method of manufacturing of a plane type surface conduction electron-emitting device are described (see FIGS. 16A and 16B). A plan view of FIG. 16A and a sectional view of FIG. 16B are shown for explaining the structure of a plane-type surface conduction electron-emitting device. In the figures, reference numeral 1101 denotes a substrate, reference numerals 1102 and 1103 denote device electrodes, reference numeral 1104 denotes a conductive thin film, reference numeral 1105 denotes an electron-emitting region formed by the energization forming operation, and reference numeral 1113 denotes a thin film formed by the energization activation operation.

As the substrate 1101, for example, various kinds of glass substrates of quartz glass, soda lime glass, or the like, various kinds of ceramic substrates such as of alumina, the above-mentioned various kinds of substrates having an insulating layer of $SiO_2$, for example, laminated thereto, or the like may be used.

The device electrodes 1102 and 1103 provided on the substrate 1101 so as to be in parallel with the substrate surface and so as to face each other are formed of a conductive material, and the used material may be appropriately selected from metals such as Ni, Cr, Au, Mo, W, Pt, Ti, Cu, Pd, Ag, alloys thereof, metal oxides such as $In_2O_3$—$SnO_2$, semiconductors such as polysilicon, and the like. The device electrodes are easily formed using a combination of film-forming technology such as vacuum evaporation and patterning technology such as photolithography or etching, but may be formed using other methods (printing technology, for example).

The shape of the device electrodes 1102 and 1103 is appropriately designed to meet the purpose of the application of the electron-emitting device. Generally, the interval L between the device electrodes is appropriately selected from the range of typically several hundred Å to several hundred μm, and, in order to apply the device to a display device, preferably, from the range of several μm to several dozen μm. The thickness d of the device electrode is appropriately selected from the range of typically several hundred Å to several μm.

The film thickness of the conductive thin film 1104 is appropriately set taking the following conditions into consideration.

More specifically, the conditions are those that are necessary for carrying out a sufficient electrical connection with the device electrode 1102 or 1103, those that are necessary for carrying out sufficient energization forming described later, and the like. The specific setting range is from several Å to several thousands Å, and preferably, the range is 10 Å to 500 Å.

Materials that can be used for forming the conductive thin film 1104 include metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, and HfN, semiconductors such as Si and Ge, and carbon, and appropriate selection is made from these.

The sheet resistance value of the conductive thin film 1104 was set to be in the range of $10^3$ to $10^7$ Ω/□.

It is to be noted that, since it is preferable that the conductive thin film 1104 and the device electrodes 1102 and 1103 are sufficiently electrically connected with each other, they are structured to partially overlap each other. The way of the overlapping is, in the example shown in FIGS. 16A and 16B, lamination of the substrate, the device electrodes, and the conductive thin film from the bottom in this order, but, depending on the situation, it may be lamination of the substrate, the conductive thin film, and the device electrodes from the bottom in this order.

The electron-emitting region 1105 is a fissure-like portion formed in a part of the conductive thin film 1104, and has a higher electrical resistance than the surrounding conductive thin film. The fissure is formed by carrying out, with respect to the conductive thin film 1104, the energization forming operation, which is described later. There are cases where particles having the particle size of several to several hundred A are disposed in the fissure. It is to be noted that, since it is difficult to accurately and exactly illustrate the position and shape of the actual electron-emitting the region, the illustration in FIGS. 16A and 16B is schematic.

The thin film 1113 is a thin film formed of carbon or a carbon compound, and covers the electron-emitting region 1105 and the vicinity thereof. The thin film 1113 is formed by carrying out, after the energization forming operation, the energization activation operation which is described later.

The thin film 1113 is a single crystalline graphite, polycrystalline graphite, amorphous carbon, or a mixture thereof. The film thickness is 500 Å or less, and preferably, 300 Å or less. It is to be noted that, since it is difficult to accurately and exactly illustrate the position and shape of the actual thin film 1113, the illustration in FIGS. 16A and 16B is schematic.

The basic structure of a preferable device is described above. In embodiments, the following devices were used.

As the substrate 1101, soda lime glass was used. As device electrodes 1102 and 1103, a thin Ni film was used. The thickness d of the device electrodes was 1000 Å, and the interval L between the device electrodes was 2 μm.

As the main material of the conductive thin film, Pd or PdO was used. Its thickness was about 100 Å and its width W was 100 μm.

Next, a preferable method of manufacturing the plane-type surface conduction electron-emitting device is now described.

FIGS. 17A to 17E are sectional views for explaining the manufacturing steps of the surface conduction electron-emitting device, in which like reference numerals denote like members in FIGS. 16A and 16B.

Figure 17A:
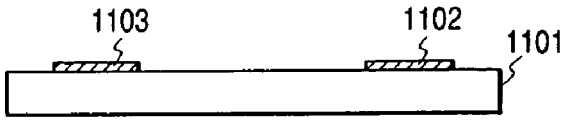
FIGS. 17A, 17B, 17C, 17D, and 17E are sectional views showing the manufacturing steps of the plane type surface conduction electron-emitting device.

1) First, as shown in FIG. 17A, the device electrodes 1102 and 1103 are formed on the substrate 1101.

In the formation, the substrate 1101 is sufficiently washed in advance using a detergent, pure water, or organic solvent, and after that, the material of the device electrodes is deposited. As the method of the deposition, for example, vacuum film-forming technology such as evaporation or sputtering may be used. After that, the deposited electrode material is patterned using photolithography/etching, and the pair of device electrodes shown in FIG. 17A (1102 and 1103) are formed.

Figure 17B:
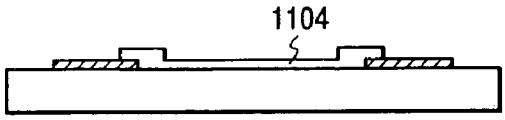

2) Next, as shown in FIG. 17B, the conductive thin film 1104 is formed.

In the formation, first, an organometallic solution is applied to the substrate shown in FIG. 17A, dried, and heating to bake is carried out to form the conductive thin film. Then, the conductive thin film is patterned to be in a predetermined shape by photolithography/etching. Here, the organometallic solution is a solution of an organometallic compound the main element of which is the material used as the conductive thin film. More specifically, in the present embodiment, Pd is used as the main element. Further, though, in the present embodiment, the dipping method was used as the method of the application, other methods such as the spinning method and the spraying method may also be used.

Further, as the method of forming the conductive thin film, other than the method of applying an organometallic solution as used in the present embodiment, vacuum evaporation, sputtering, or chemical vapor deposition may also be used.

Figure 17C:
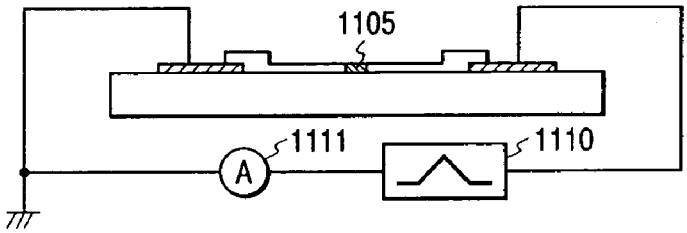

3) Then, as shown in FIG. 17C, appropriate voltage is applied between the device electrodes 1102 and 1103 from a power source 1110 for forming to carry out the energization forming operation, and the electron-emitting region 1105 is formed.

The energization forming operation is the operation to energize the conductive thin film 1104 to appropriately locally destroy, deform, or denature it, thus changing it to have a structure suitable for emitting electrons. The portion of the conductive thin film that has been changed to have the structure suitable for emitting electrons (that is, the electron-emitting region 1105) has an appropriate fissure formed therein. It is to be noted that, compared with the electrical resistance between the device electrodes 1102 and 1103 before the electron-emitting region 1105 is formed, the electrical resistance after the electron-emitting region 1105 is formed greatly increases.

Figure 18:
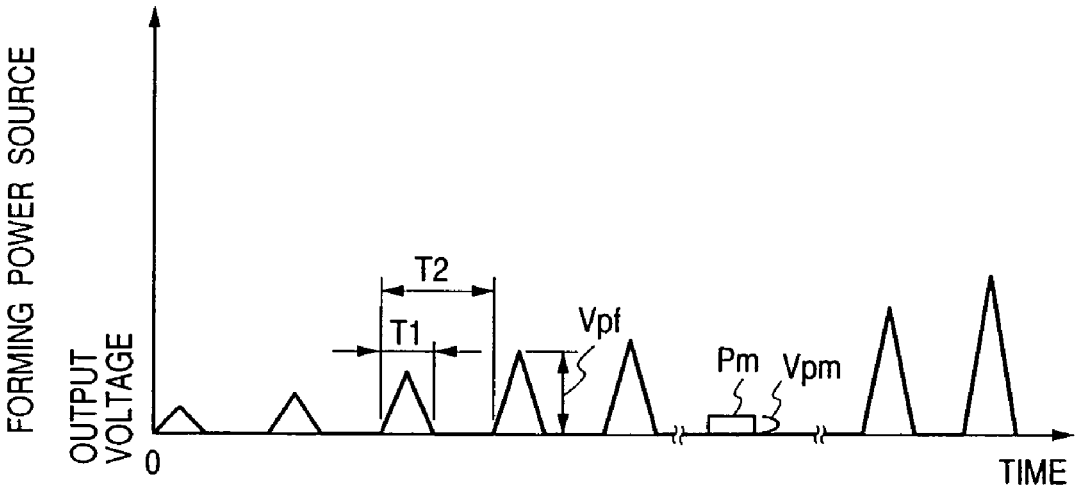
FIG. 18 is a view showing the waveform of the applied voltage in the energization forming operation.

For the purpose of describing the method of energization in more detail, FIG. 18 shows an example of the waveform of the appropriate voltage applied from the power source 1110 for forming. In forming the conductive thin film, it is preferable to apply pulse-like voltage, and in the present embodiment, as shown in FIG. 18, triangular pulses having the pulse width of T1 were continuously applied with the pulse intervals being T2. Here, the pulse height value Vpf of the triangular pulses was gradually increased. Further, monitoring pulses Pm for monitoring the state of formation of the electron-emitting region 1105 were inserted between the triangular pulses at appropriate intervals, and the electric current flowing at that time was measured with an ammeter 1111.

In the embodiment, for example, in a vacuum atmosphere of about $10^{-3}$ Pa, the pulse width T1 was set to be 1 millisecond, the pulse interval T2 was set to 10 milliseconds, and the pulse height value Vpf was increased by 0.1V per pulse. One monitoring pulse Pm was inserted after every five triangular pulses. In order to avoid adverse effects on the forming operation, the voltage Vpm of the monitoring pulses was set to 0.1V. When the electrical resistance between the device electrodes 1102 and 1103 became $1\times10^6$ Ω, that is, when the electric current measured with the ammeter 1111 when the monitoring pulse was applied became $1\times10^{-7}$ A or less, the energization for the forming operation was ended.

It is to be noted that the above method is a preferable method with respect to the surface conduction electron-emitting device of the present embodiment, and, when the design of the surface conduction electron-emitting device such as the material or thickness of the conductive thin film or the interval L between the device electrodes is changed, it is preferable that the conditions of the energization are changed accordingly.

Figure 17D:
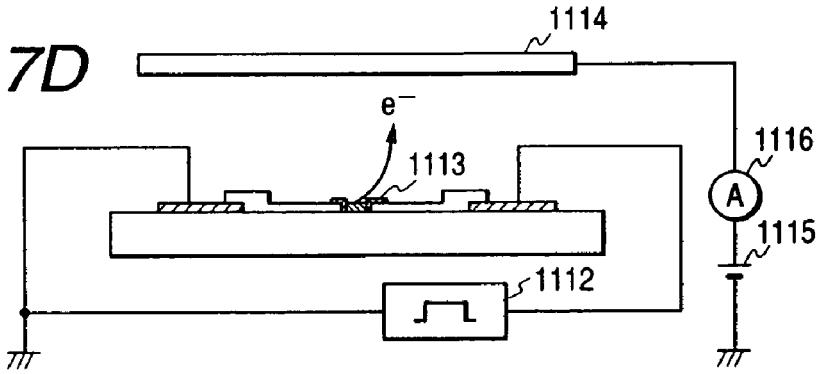

4) Next, as shown in FIG. 17D, an appropriate voltage is applied between the device electrodes 1102 and 1103 from a power source 1112 for the activation to carry out the energization activation operation, and the electron-emitting characteristics are improved.

The energization activation operation is the operation to energize on appropriate conditions the electron-emitting region 1105 formed by the above-mentioned energization forming operation to deposit carbon or a carbon compound in the vicinity of the electron-emitting region 1105. (In the figure, the deposit formed of carbon or the carbon compound is schematically illustrated as a member 1113.) It is to be noted that, by carrying out the energization activation operation, the emission electric current at the same applied voltage can be made, typically, a hundred times as much as that before the operation, or larger.

More specifically, by, for example, applying the voltage pulses periodically in a vacuum atmosphere in the range of $10^{-2}$ to $10^{-3}$ Pa, carbon or a carbon compound the origin of which is the organic compound existing in the vacuum atmosphere is deposited. The deposit 1113 is single crystalline graphite, polycrystalline graphite, amorphous carbon, or a mixture thereof. The film thickness is 500 Å or less, and preferably, 300 Å or less.

Figure 19A:
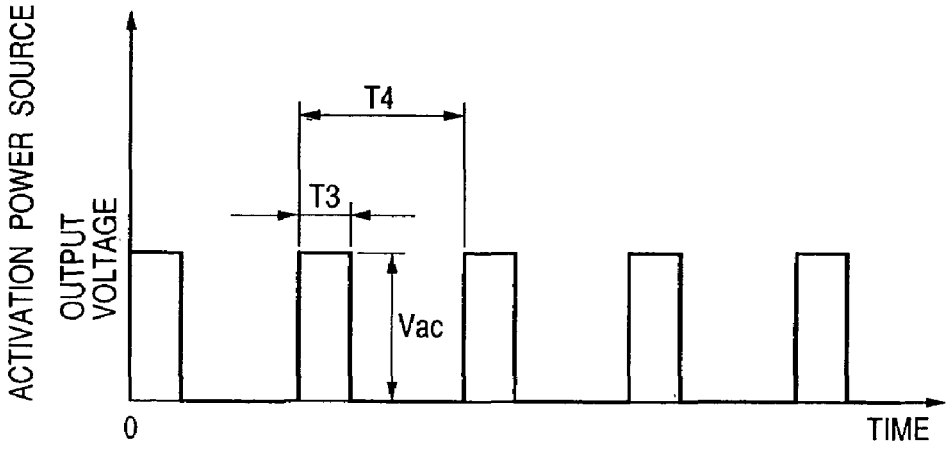
FIGS. 19A and 19B are views showing the waveform of the applied voltage and the change in the emission current Ie in the energization activation operation.

For the purpose of describing the method of energization in more detail, FIG. 19A shows an example of the waveform of the appropriate voltage applied from the power source 1112 for activation. In the embodiment, the energization activation operation was carried out by periodically applying rectangular waves of constant voltage. More specifically, the voltage Vac of the rectangular waves was set to 14V, the pulse width T3 was set to 1 millisecond, and the pulse interval T4 was set to 10 millisecond. It is to be noted that the above energization conditions are preferable with respect to the surface conduction electron-emitting device of the present embodiment, and, when the design of the surface conduction electron-emitting device is changed, it is preferable that the conditions are changed accordingly.

Figure 19B:
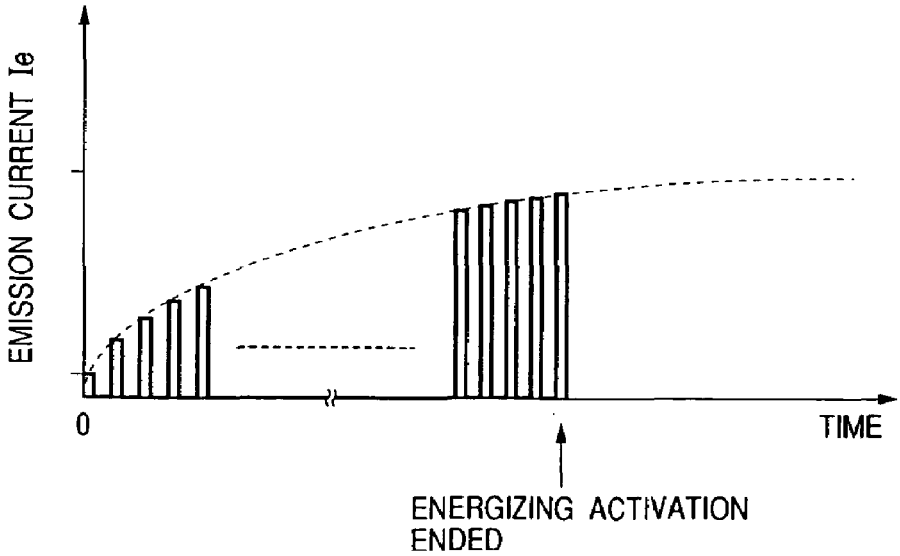

Reference numeral 1114 shown in FIG. 17D denotes an anode electrode for capturing emission electric current Ie emitted from the surface conduction electron-emitting device. The anode electrode 1114 is connected with a dc high voltage power source 1115 and an ammeter 1116. (It is to be noted that, when the activation operation is carried out after the substrate 1101 is incorporated into the display panel, the fluorescent surface of the display panel is used as the anode electrode 1114). Voltage is applied from the power source 1112 for activation, the emission electric current Ie is measured with the ammeter 1116 to monitor the progress of the energization activation operation, and the operation of the power source 1112 for activation is controlled. An example of the emission electric current Ie measured with the ammeter 1116 is shown in FIG. 19B. When the pulse voltage begins to be applied from the power source 1112 for activation, the emission electric current Ie increases as time passes, but then, it saturates and almost no increase is observed. When the emission electric current Ie almost saturates in this way, the application of voltage from the power source 1112 for activation is stopped, and the energization activation operation is ended.

It is to be noted that the above energization conditions are preferable with respect to the surface conduction electron-emitting device of the present embodiment, and, when the design of the surface conduction electron-emitting device is changed, it is preferable that the conditions are changed accordingly.

Figure 17E:
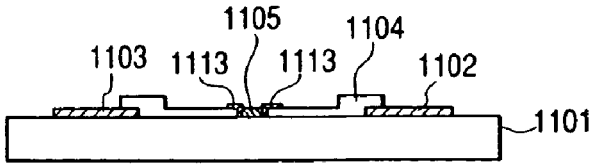

In the manner described above, the plane-type surface conduction electron-emitting device shown in FIG. 17E was manufactured.

Step-Type Surface Conduction Electron-Emitting Device

Next, the structure of the other representative structure of surface conduction electron-emitting devices, that is, the structure of a step-type surface conduction electron-emitting device, is described.

Figure 20:
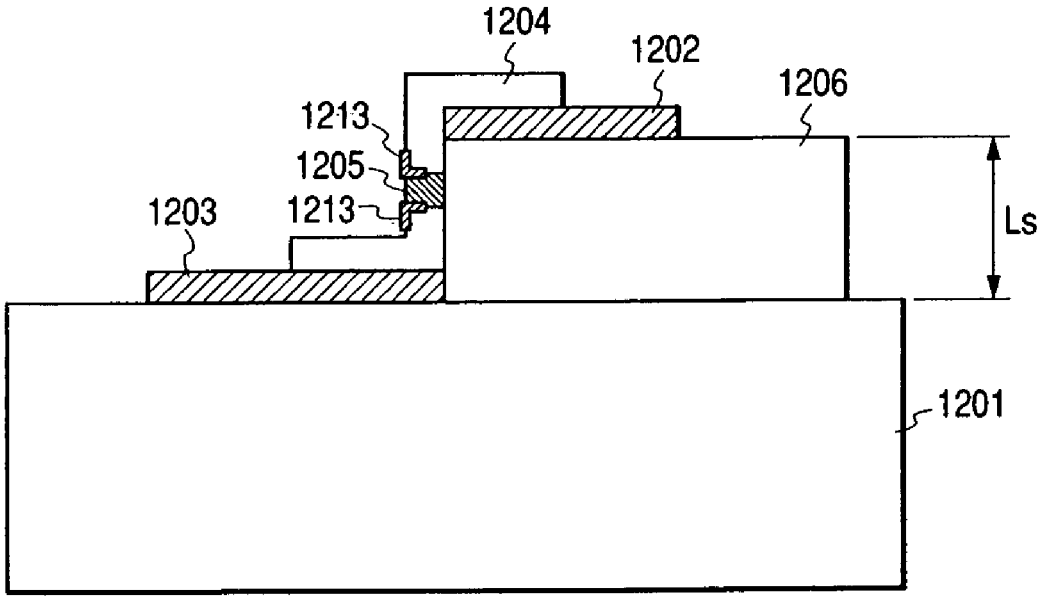
FIG. 20 is a sectional view of a step type surface conduction electron-emitting device used in the embodiments.

FIG. 20 is a schematic sectional view for explaining the basic structure of the step type. In the figure, reference numeral 1201 denotes a substrate, reference numerals 1202 and 1203 denote device electrodes, reference numeral 1206 denotes a step-forming member, reference numeral 1204 denotes a conductive thin film, reference numeral 1205 denotes an electron emitting region formed by energization forming operation, and reference numeral 1213 denotes a thin film formed by the energization activation operation.

The step-type device is different from the plane-type device in that one of the device electrodes (1202) is provided on the step-forming member 1206, and the conductive thin film 1204 covers a side surface of the step-forming member 1206. Therefore, in the step-type device, the interval L between the device electrodes in the plane-type shown in FIG. 16A is set as the step height Ls of the step-forming member 1206. It is to be noted that with regard to the substrate 1201, the device electrodes 1202 and 1203 and the conductive thin film 1204, materials listed in describing the plane-type device can be used similarly. With regard to the step-forming member 1206, an electrically insulating material such as $SiO_2$ is used.

Next, a method of manufacturing the step-type surface conduction electron-emitting device is now described. FIGS. 21A to 21F are sectional views for explaining the manufacturing steps, in which like reference numerals denote like members in FIG. 20.

Figure 21A:
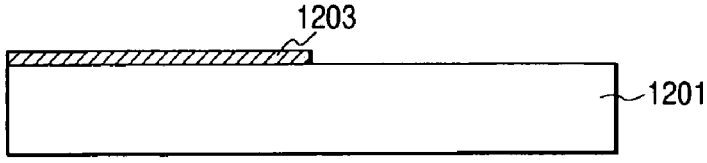
FIGS. 21A, 21B, 21C, 21D, 21E, and 21F are sectional views showing the manufacturing steps of the step type surface conduction electron-emitting device.

1) First, as shown in FIG. 21A, the device electrode 1203 is formed on the substrate 1201.

Figure 21B:
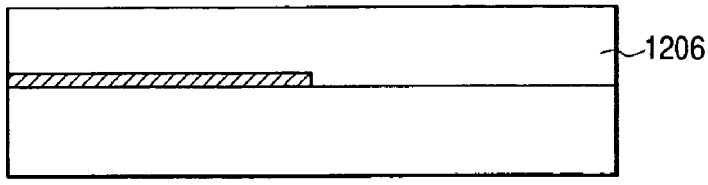

2) Next, as shown in FIG. 21B, an insulating layer for forming the step-forming member is laminated. The insulating layer may be formed by, for example, laminating a $SiO_2$ film by sputtering, but other film forming methods such as vacuum evaporation or the printing method may also be used.

Figure 21C:
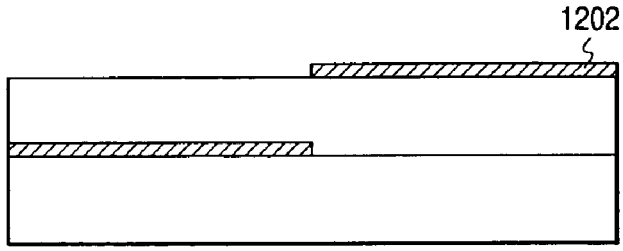

3) Then, as shown in FIG. 21C, the device electrode 1202 is formed on the insulating layer.

Figure 21D:
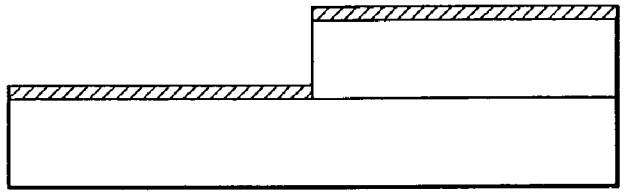

4) Next, as shown in FIG. 21D, a part of the insulating layer is removed by, for example, etching, to expose the device electrode 1203.

Figure 21E:
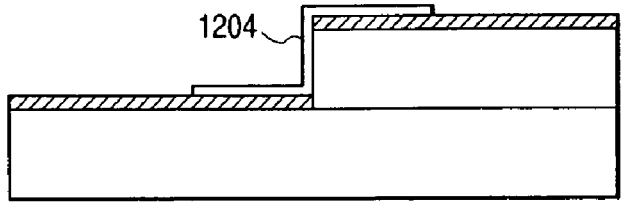

5) Next, as shown in FIG. 21E, the conductive thin film 1204 is formed. In the formation, in the same way as in the case of the above-mentioned plane type, film-forming technology such as the applying method may be used.

6) Then, similarly to the case of the above-mentioned plane-type device, the energization forming operation is carried out to form the electron-emitting region (operation similar to the energization forming operation of the plane-type devices described with reference to FIG. 17C is carried out).

7) Next, similarly to the case of the above-mentioned plane-type device, the energization activation operation is carried out to deposit carbon or a carbon compound in the vicinity of the electron-emitting region (operation similar to the energization activation operation of the plane-type device described with reference to FIG. 17D is carried out).

Figure 21F:
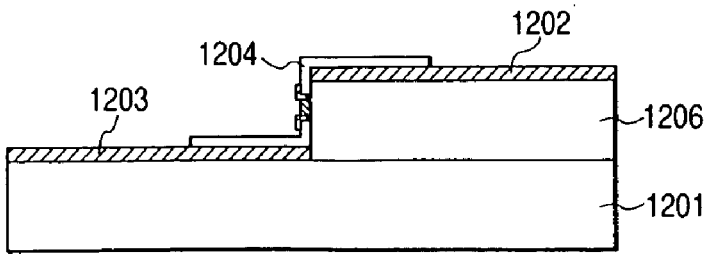

In the manner described above, the step-type surface conduction electron-emitting device shown in FIG. 21F is manufactured.

Characteristics of Surface Conduction Electron-Emitting Device Used in Display Device The device structure and the method of manufacturing of the plane-type and step-type surface conduction electron-emitting devices are described above. Next, the characteristics of the device used in a display device are described.

Figure 22:
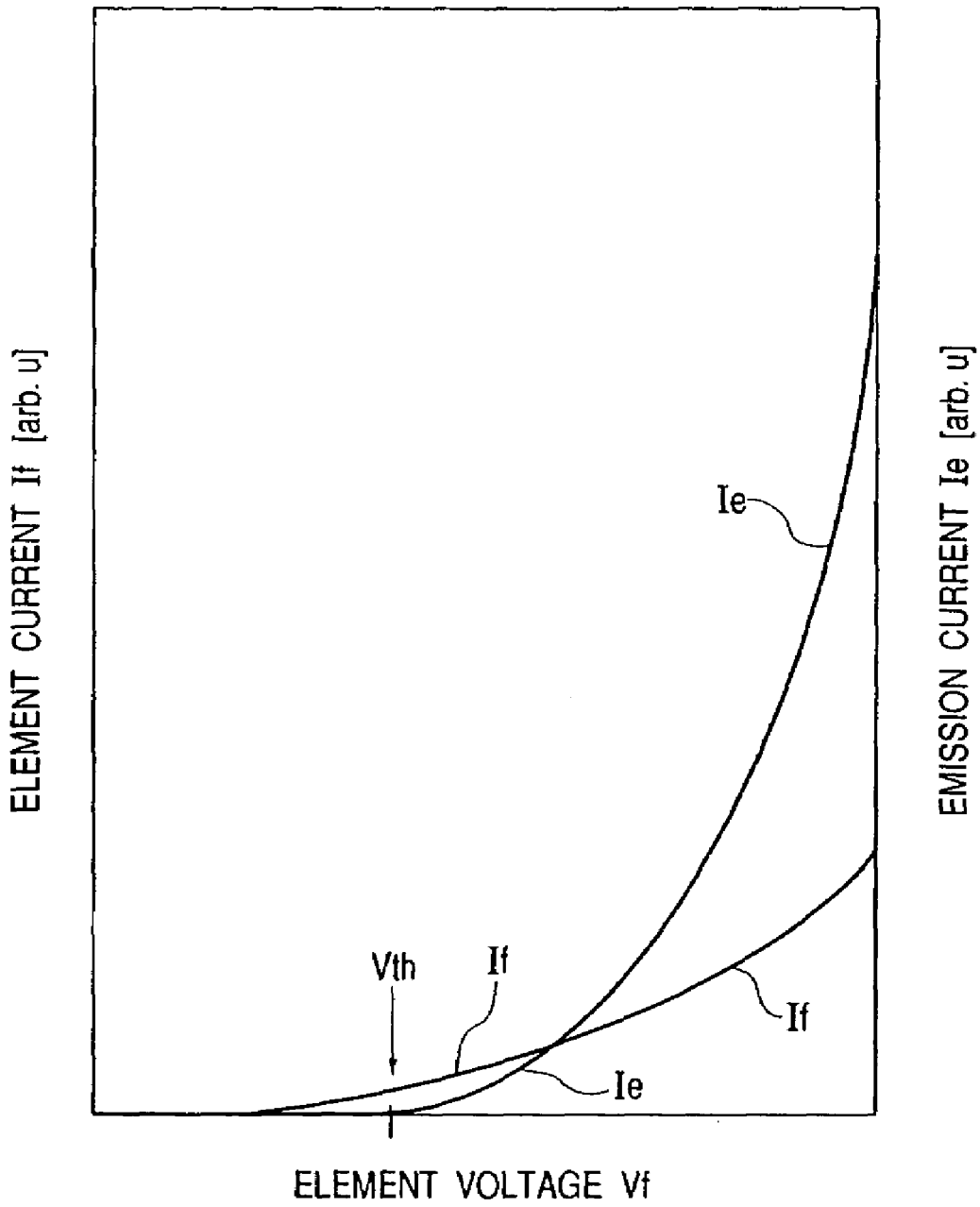
FIG. 22 is a graph showing typical characteristics of the surface conduction electron-emitting device used in the embodiments.

FIG. 22 shows typical examples of (the emission electric current Ie) vs. (the voltage Vf applied to the device) characteristics and (the device electric current If) vs. (the voltage Vf applied to the device) characteristics of the device used in the display device. It is to be noted that, since the emission electric current Ie is significantly smaller than the device electric current If, which makes it difficult to show the two to scale, and since these characteristics change as the design parameters such as the size and the shape of the device-change, the two graphs are shown based on their respective units.

The device used in the display device has the following three characteristics with regard to the emission electric current Ie.

First, when voltage that equals to or is higher than a predetermined voltage (referred to as the threshold voltage Vth) is applied to the device, the emission electric current Ie sharply increases, while, when the voltage is lower than the threshold voltage Vth, the detected emission electric current Ie is almost zero. In other words, the device is a nonlinear device having a definite threshold voltage Vth with respect to the emission electric current Ie.

Second, since the emission electric current Ie changes depending on the voltage Vf applied to the device, the emission electric current Ie can be controlled by the voltage Vf.

Third, since the response speed of the electric current Ie emitted from the device to the voltage Vf applied to the device is high, the amount of charge of the electrons emitted by the device can be controlled by the time length during which the voltage Vf is applied.

Since the surface conduction electron-emitting device has the above characteristics, it can be suitably used in the display device. For example, in a display device where a plurality of devices are provided so as to correspond to pixels of the display screen, by using the first characteristic, display can be carried out with the display screen being scanned sequentially. More specifically, voltage that equals to or is higher than the threshold voltage Vth is appropriately applied according to the desired brightness of emission to a device that is being driven, while voltage lower than the threshold voltage Vth is applied to an unselected device. By sequentially switching the device that is being driven, display with the display screen being scanned sequentially can be carried out.

Further, by utilizing the second or third characteristic, the brightness of the light emission can be controlled, and thus, a gradation display can be carried out.

Structure of Multiple Electron Beam Source with a Plurality of Devices being Wired to be Simple Matrix-Like Next, the structure of a multiple electron beam source with the above-mentioned surface conductive electron-emitting devices being arranged on a substrate and wired to be simple matrix-like is described.

FIG. 10 shows a plan view of a multiple electron beam source used in the display panel of FIG. 9. Surface conduction electron-emitting devices similar to those shown in the above-mentioned FIGS. 16A and 16B are arranged on the substrate, and these devices are wired to be simple matrix-like by the row direction wiring electrodes 1003 and the column direction wiring electrodes 1004. An insulating layer (not shown) is formed between electrodes at the intersections of the row direction wiring electrodes 1003 and the column direction wiring electrodes 1004 to maintain electric insulation. FIG. 11 shows a sectional view taken along the line 11—11 in FIG. 10.

It is to be noted that the multiple electron source structured in this way is manufactured by forming in advance the row direction wiring electrodes 1013, the column direction wiring electrodes 1014, the insulating layer (not shown) between electrodes, and device electrodes and conductive thin films of the surface conduction electron-emitting devices on the substrate and then supplying power to the respective devices through the row direction wiring electrodes 1013 and the column direction wiring electrodes 1014 to carry out the energization forming operation and the energization activation operation.

Structure of Driving Circuit and Driving Method

Figure 23:
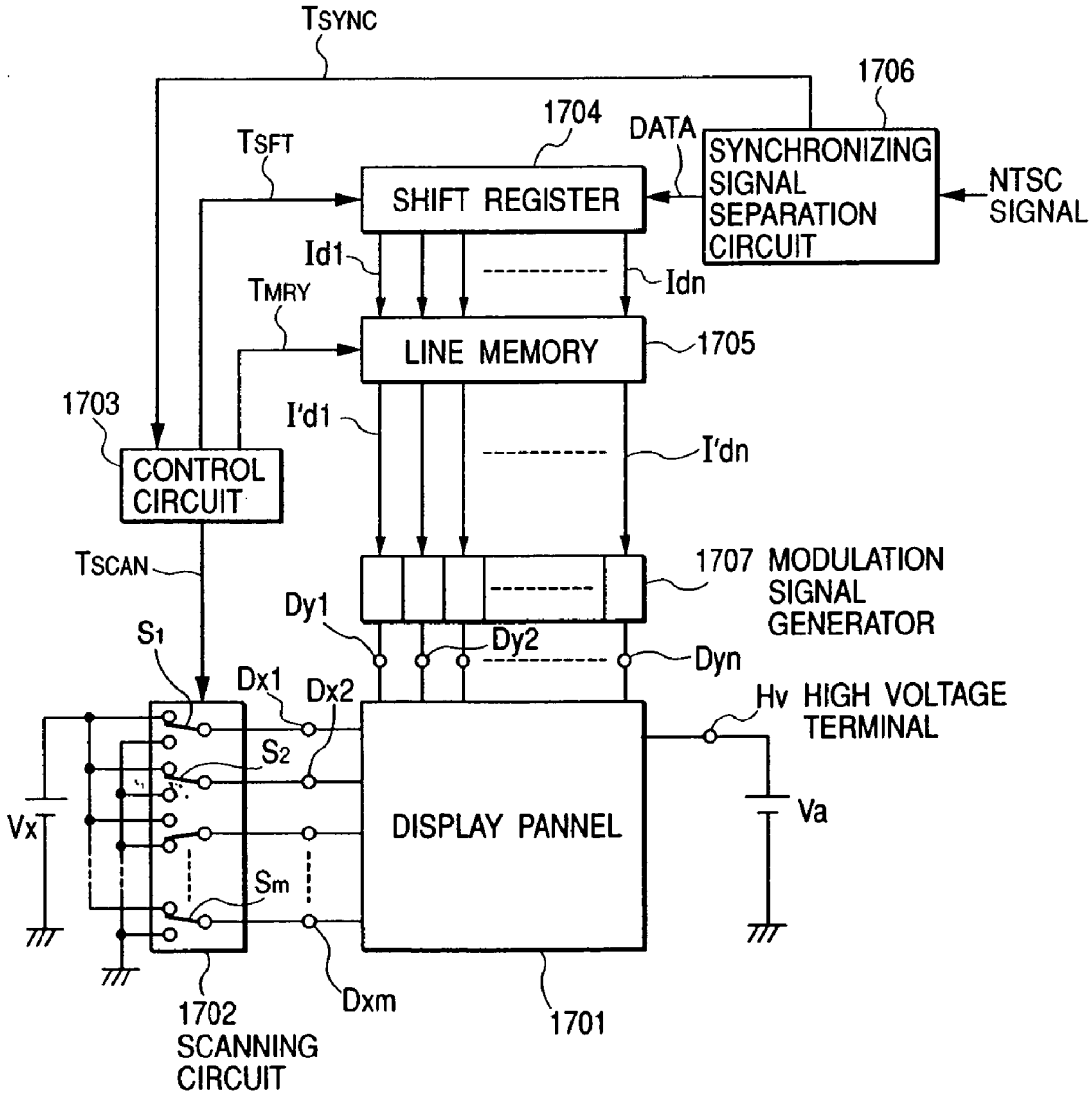
FIG. 23 is a block diagram showing the schematic structure of a driving circuit of an image display device as an embodiment of the present invention.

FIG. 23 is a block diagram showing the schematic structure of a driving circuit for a television display based on NTSC television signals. In the figure, a display panel 1701 corresponds to the above-mentioned display panel, and is manufactured and operates as described above. A scanning circuit 1702 scans display lines, and a control circuit 1703 generates signals to be inputted to the scanning circuit and the like. A shift register 1704 shifts data for one line, and a line memory 1705 inputs data for one line from the shift register 1704 to a modulation signal generator 1707. A synchronizing signal separation circuit 1706 separates a synchronizing signal from NTSC signals.

In the following, functions of the respective portions of the device shown in FIG. 23 are described in detail.

First, the display panel 1701 is connected with external electric circuits through the terminals Dx1 to Dxm, the terminals Dy1 to Dyn, and the high-voltage terminal Hv. A scanning signal for sequentially driving the multiple electron beam source provided in the display panel 1701, that is, the cold cathode devices wired to be matrix-like in m rows and n columns row by row (n devices at a time) is applied to the terminals Dx1 to Dxm. On the other hand, a modulation signal for controlling output electron beams of each of the n devices in one row selected by the scanning signal is applied to the terminals Dy1 to Dyn. Dc voltage of, for example, 5 kV is supplied from a dc voltage source Va to the high-voltage terminal Hv. This is accelerating voltage for giving enough energy to excite the phosphor to the electron beams outputted from the multiple electron beam source.

Next, the scanning circuit 1702 is described. The circuit has therein m switching devices (schematically shown as $S_1$ to $S_m$ in the figure). The respective switching devices select either the voltage outputted by a dc voltage source Vx or 0V (ground level) and electrically connect the voltage with the terminals Dx1 to Dxm, respectively, of the display panel 1701. The switching devices $S_1$ to $S_m$ operate based on a control signal $T_{SCAN}$, outputted by the control circuit 1703, and in practice, can be easily formed by combining switching devices such as FETs. It is to be noted that the dc voltage source Vx is set to output constant voltage such that the driving voltage to be applied to a device that is not scanned is not higher than the threshold voltage Vth based on the characteristics of the electron-emitting devices shown in FIG. 22.

Further, the control circuit 1703 has a function to match the operation of the respective portions such that appropriate display is carried out based on an image signal inputted from the external. It generates control signals $T_{SCAN}$, $T_{SFT}$ and $T_{MRY}$ to the respective portions based on a synchronizing signal $T_{SYNC}$ sent from the synchronizing signal separation circuit 1706 described in the following. The synchronizing signal separation circuit 1706 is a circuit for separating a synchronizing signal component and a brightness signal component from NTSC television signals inputted from the external, and as well known, can be easily formed by using a frequency separation (filter) circuit. As is well-known, a synchronizing signal separated by the synchronizing signal separation circuit 1706 consists of a vertical synchronizing signal and a horizontal synchronizing signal, but here, for convenience, it is shown as the $T_{SYNC}$ signal. On the other hand, a brightness signal component of an image separated from the television signals is, for convenience's sake, shown as a DATA signal, which is inputted to the shift register 1704.

The shift register 1704 carries out serial/parallel conversion of the DATA signal inputted serially in time sequence with regard to one line of an image, and operates based on the control signal $T_{SFT}$ sent from the control circuit 1703. In other words, the control signal $T_{SFT}$ is a shift clock of the shift register 1704. The data for one line of an image after the serial/parallel conversion (which corresponds to driving data for n electron-emitting devices) is outputted from the shift register 1704 as n signals $I_{D1}$ to $I_{DN}$.

The line memory 1705 is a memory for storing data for one line of an image for a necessary time length, and appropriately stores the content of $I_{D1}$ to $I_{DN}$ according to the control signal $T_{MRY}$ sent from the control circuit 1703. The stored content is outputted as $I'_{D1}$ to $I'_{DN}$ to be inputted to the modulation signal generator 1707.

The modulation signal generator 1707 is a signal source to appropriately drive and modulate the respective electron-emitting devices 1015 according to the image data $I'_{D1}$ to $I'_{DN}$, and its output signal is applied through the terminals Dy1 to Dyn to the electron-emitting devices 1015 in the display panel 1701.

As described with reference to FIG. 22, the surface conduction electron-emitting device according to the present invention has the following basic characteristics with regard to the emission electric current Ie. The electron emission has a definite threshold voltage Vth (8V in case of a surface conduction electron-emitting device in an embodiment described later), and electron emission is caused only when voltage that is equal to or is higher than the threshold voltage Vth is applied. With regard to voltage that is equal to or is not lower than the threshold voltage Vth, as shown in the graph of FIG. 22, the emission electric current Ie changes according to the change in the voltage. This means that, in the case of applying pulse-like voltage to the devices of the invention, an electron emission is not caused when voltage not higher than the threshold voltage Vth is applied, while electron beams are outputted from the surface conduction electron-emitting devices when voltage that is equal to or is not lower than the threshold voltage Vth is applied. Here, by changing the pulse height value Vm of the pulses, the strength of the outputted electron beams can be controlled. Further, by changing the pulse width Pw, the total amount of charge of the outputted electron beams can be controlled.

Therefore, as the method of modulating the electron-emitting devices according to an inputted signal, voltage modulation, pulse-width modulation, and the like can be adopted. In adopting the voltage modulation, as the modulation signal generator 1707, a voltage modulation circuit, which generates voltage pulses having a constant length and appropriately modulates the pulse height value of the pulses according to the inputted data, can be used. In adopting the pulse-width modulation, as the modulation signal generator 1707, a pulse-width modulation circuit, which generates voltage pulses having a constant pulse height value and appropriately modulates the width of the voltage pulses according to the inputted data, can be used.

The shift register 1704 and the line memory 1705 may be of the digital signal system or may be of the analog digital signal system, because the serial/parallel conversion and storage of the image signals just have to be carried out at a predetermined speed.

In the case that the digital signal system is used, it is necessary to make the output signal DATA of the synchronizing signal separation circuit 1706 as a digital signal. This can be accomplished by providing an A/D converter at the output portion of the synchronizing signal separation circuit 1706. In relation to this, the circuits used as the modulation signal generator differ a little depending on whether the output signal of the line memory 115 is a digital signal or an analog signal. More specifically, in the case of the voltage modulation using a digital signal, a D/A conversion circuit, for example, is used as the modulation signal generator 1707, and an amplification circuit and the like are added as necessity requires. In the case of the pulse-width modulation, as the modulation signal generator 1707, a combination of, for example, a high speed oscillator, a counter for counting the number of waves outputted by the oscillator, and a comparator for comparing the output value of the counter with the output value of the memory is used. As necessity requires, an amplifier for amplifying the voltage of the modulation signal after pulse-width modulation outputted by the comparator to the driving voltage of the electron-emitting devices may be added.

In the case of the voltage modulation using an analog signal, an amplification circuit using an operational amplifier, for example, can be adopted as the modulation signal generator 1707, and, as necessity requires, a shift level circuit and the like may be added. In the case of the pulse-width modulation, a voltage-controlled oscillator (VCO), for example, can be adopted, and, as necessity requires, an amplifier for amplifying the voltage to the driving voltage of the electron-emitting devices may be added.

In an image display device to which the present invention is applicable and which can be structured as described above, by applying voltage to the respective electron-emitting devices through the terminals Dx1 to Dxm and Dy1 to Dyn outside the container, an electron emission is caused. High voltage is applied to the metal back 1019 or a transparent electrode (not shown) through the high voltage terminal Hv to accelerate the electron beams. The accelerated electrons impact the fluorescent film 1018 to cause a light emission and an image is displayed.

The structure of the image display device described here is an example of an image forming apparatus to which the present invention is applicable, and various modifications may be made based on the idea of the present invention. The input signals are described as NTSC ones, but the input signals are not limited thereto, and PAL signals, SECAM signals, and other TV signals formed of scanning lines the amount of which is greater than those of the above signals (high-definition TV such as MUSE) may also be adopted.

In the Case of Ladder-Like Electron Source

Next, the above-described ladder-like arranged electron source substrate and an image display device using it are described with reference to FIGS. 24 and 25.

Figure 24:
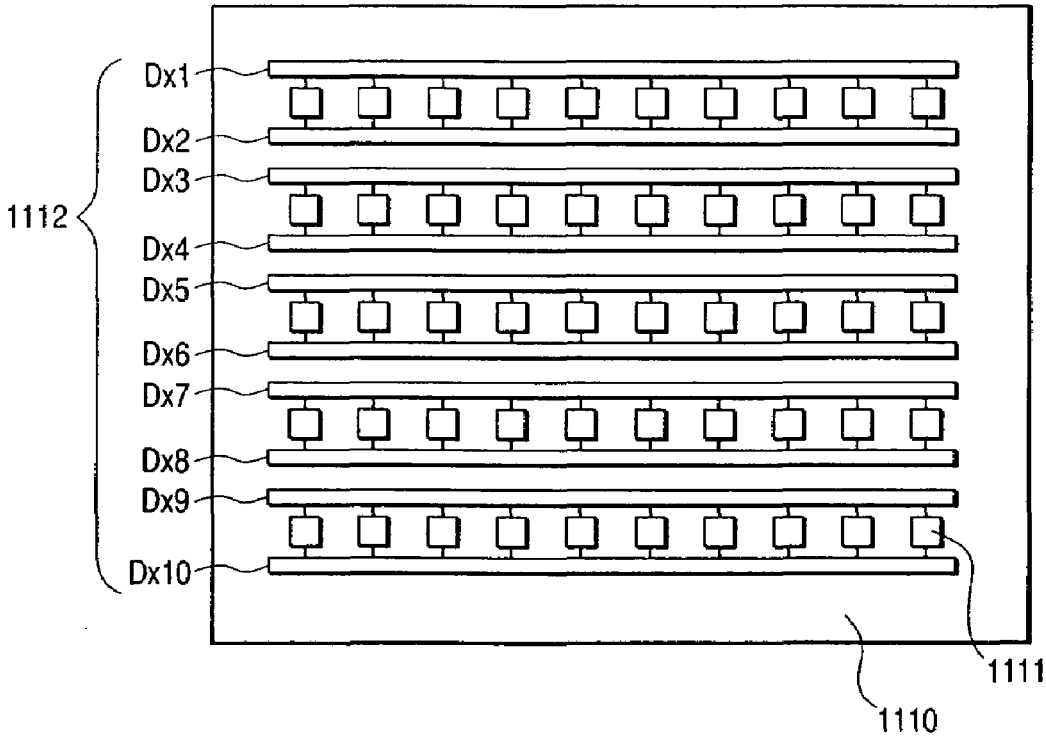
FIG. 24 is a schematic plan view of an electron source arranged to be ladder-like as an example of the present invention.

In FIG. 24, reference numeral 1110 denotes an electron source substrate, reference numeral 1111 denotes an electron-emitting device, and reference numerals Dx1 to Dx10 of 1112 denote common wirings connecting with the electron-emitting devices. A plurality of electron-emitting devices 1111 are disposed on the substrate 1110 so as to be in parallel in the X direction (referred to as device rows). A plurality of such device rows are disposed on the substrate to form the ladder-like electron source substrate. By applying appropriate driving voltage between common wirings of the device rows, the respective device rows can be driven separately. More specifically, voltage, which is equal to or is higher than the threshold voltage, is applied to device rows from which electron beams are to be emitted, while voltage, which is lower than the threshold voltage, is applied to device rows from which no electron is to be emitted. The common wirings Dx2 to Dx9 between the respective device rows, for example, Dx2 and Dx3, may be the same wirings.

Figure 25:
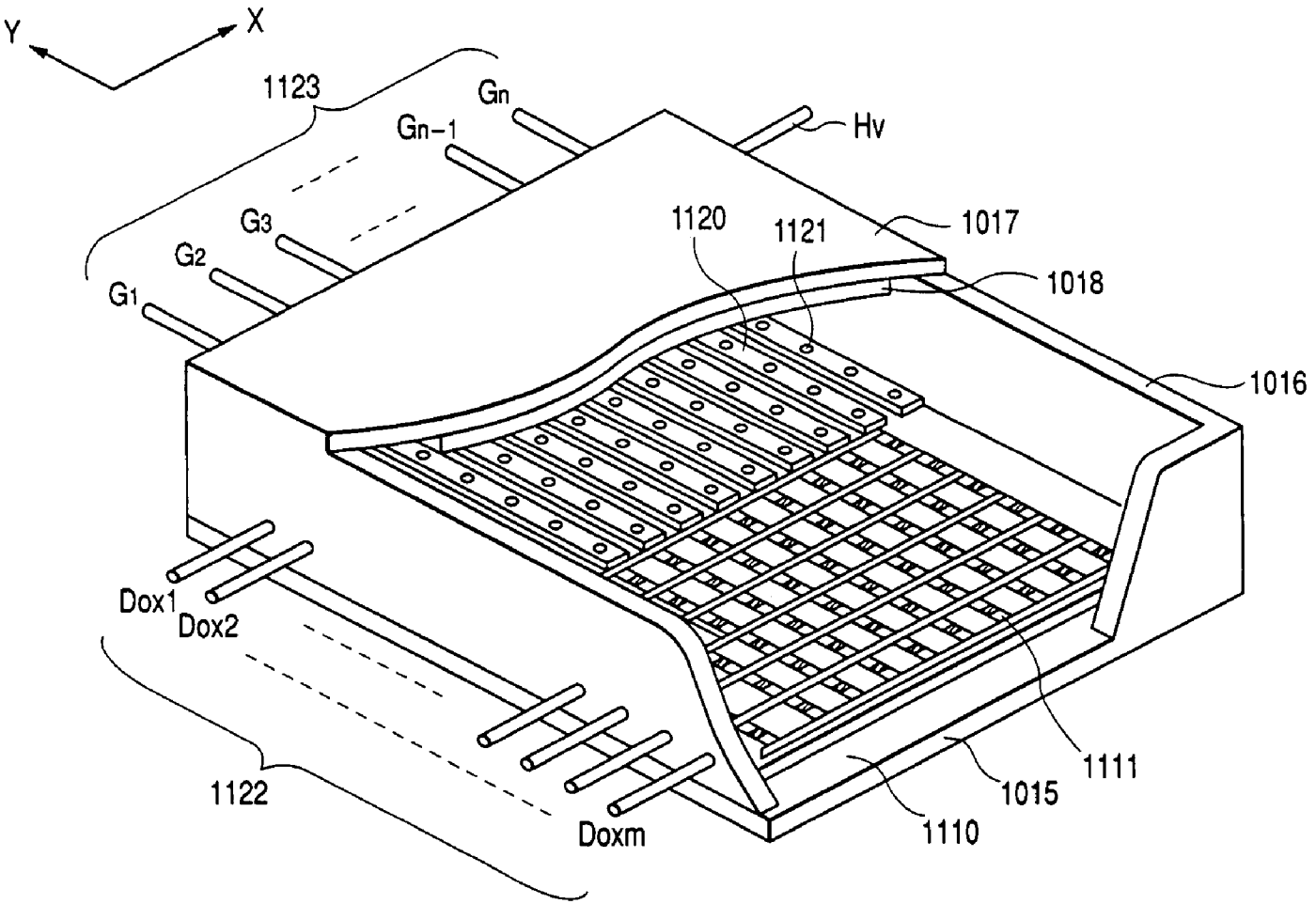
FIG. 25 is a perspective view of a plane-type display device having the electron source arranged to be ladder-like as an example of the present invention (spacers are not shown).
Figure 26:
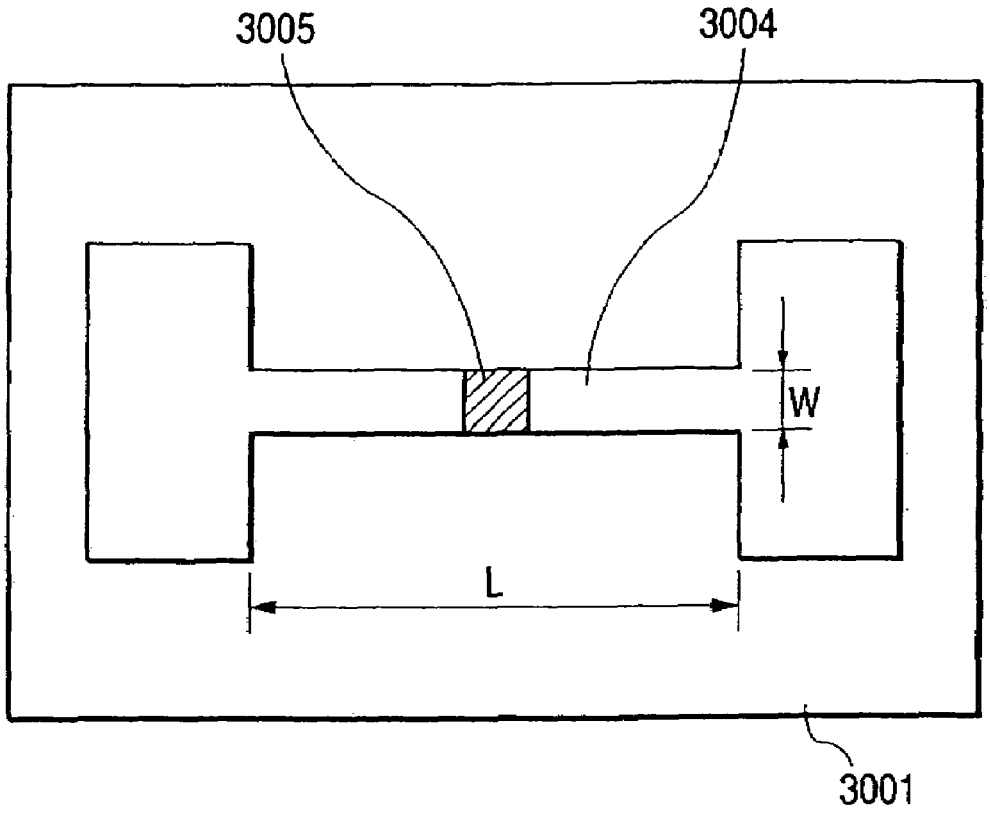
FIG. 26 PRIOR ART
FIG. 26 is a plan view showing an example of a conventionally known surface conduction electron-emitting device.
Figure 27:
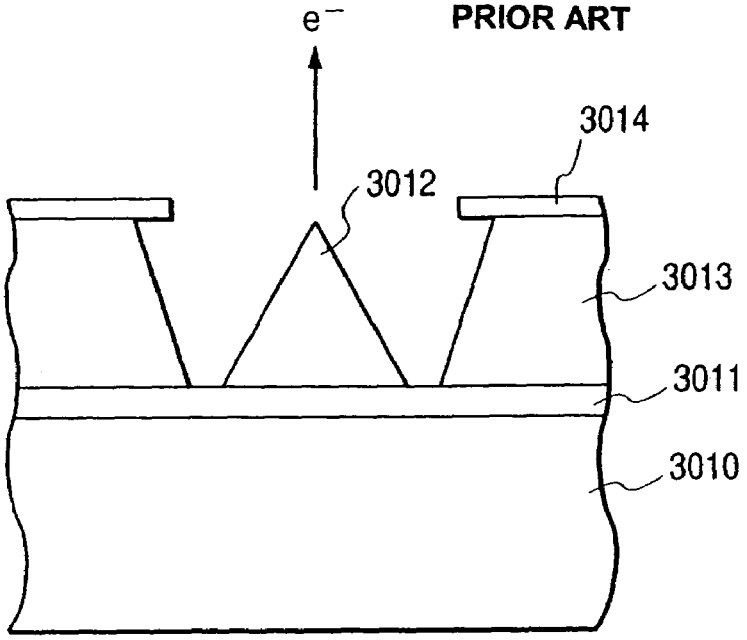
FIG. 27 is a sectional view showing an example of a conventionally known FE type device.
Figure 28:
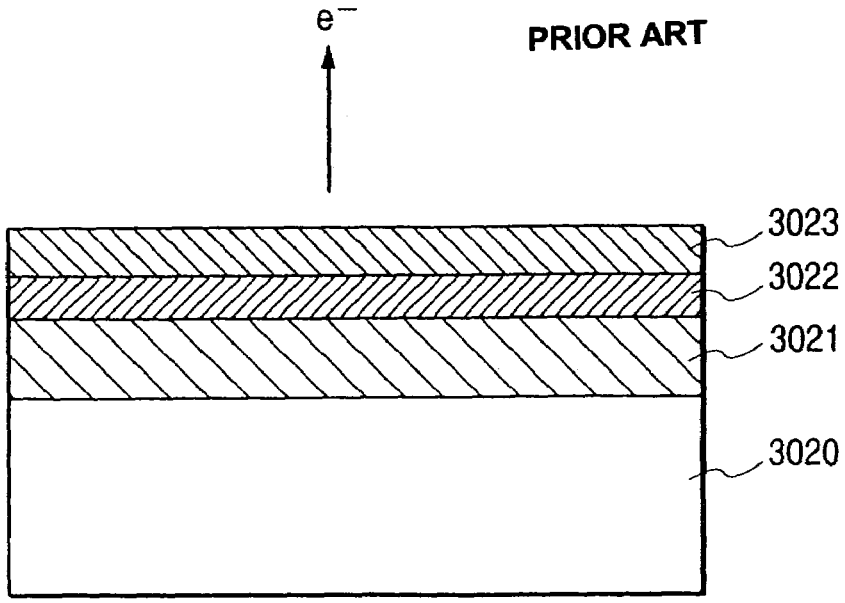
FIG. 28 is a sectional view showing an example of a conventionally known MIM type device.

FIG. 25 shows the structure of an image forming apparatus provided with the ladder-like arranged electron source. Reference numeral 1120 denotes a grid electrode, reference numeral 1121 denotes a hole through which electrons pass, reference numeral 1122 denotes terminals Dox1, Dox2, . . . Doxm outside the container, and reference numeral 1110 denotes the electron source substrate where the common wirings between the respective device rows are the same wirings as described above. It is to be noted that like reference numerals in FIG. 25 denote like members in FIG. 24. The image-forming apparatus differs from the image-forming apparatus of the simple matrix-like arrangement described above (FIG. 9) in that the grid electrodes 1120 are provided between the electron source substrate 1110 and the face plate 1017.

In the above-described panel structures, whether the electron source arrangement is matrix-like or ladder-like, as necessity requires from the viewpoint of the atmospheric pressure withstanding structure, spacer members (not shown) may be provided between the face plate and the rear plate.

The grid electrodes 1120 are provided between the electron source substrate 1110 and the face plate 1017. The grid electrodes 1120 can modulate electron beams emitted from the surface conduction electron-emitting devices. In order to pass the electron beams through the stripe-like grid electrodes provided orthogonally to the ladder-like arranged device rows, one circular opening 1121 is provided so as to correspond to each device. The shape and the position of the grids are not limited to those shown in FIG. 25. A large number of openings may be provided so as to be mesh-like, and the grids may be provided around or in the vicinity of the surface conduction electron-emitting devices, for example.

The terminals 1122 outside the container and the grid terminals 1123 outside the container are electrically connected with a control circuit, which is not shown.

In the present image forming apparatus, by applying a modulation signal for one line of an image to the grid electrode columns simultaneously with and synchronously with sequential driving (scanning) of the device rows one by one, irradiation of the phosphor by the respective electron beams is controlled to make it possible to display lines of the image one by one.

Further, according to the present invention, not only a display device for television broadcasting but also image-forming apparatus suitable for display devices for a television conference system, a computer, and the like can be provided. Further, it may be used as an image-forming apparatus as an optical printer formed of a photosensitive drum and the like.

As described above, according to the present invention, application of a low resistance film on a spacer member by liquid phase formation makes the process simple and easy, and the electrical contact and discharge-withstanding voltage of the obtained low resistance film are sufficient, and thus, the present invention improves the display quality of an electron beam display, and is particularly effective with regard to a manufacturing process, which requires mass-production, lower cost, and the like, and with regard to an electron beam apparatus using the manufacturing process.

EMBODIMENTS

The present invention is now described in further detail with regard to embodiments.

In the respective embodiments described in the following, as the multiple electron beam source, the above-mentioned multiple electron beam source where the n×m (n=3072, m=1024) surface conduction electron-emitting devices of the type having the electron-emitting region in the conductive particle film between electrodes were wired to be matrix-like by m row direction wirings and n column direction wirings (see FIGS. 9 and 10) was used.

Embodiment 1

Thermal Energy Emission Type

The spacers used in the present embodiment were formed as described in the following.

A base material formed of soda lime glass, which was the same material as that of the rear plate, was processed using hot-draw, and pillar-like glass was formed having the following dimensions in section as shown in FIGS. 1A, 1B, and 3A-4: 3 mm in width; 0.2 mm in thickness; and 0.02 mm in radius of curvature R at the four vertexes. The glass was cut to have the length of 40 mm to obtain a spacer substrate g1. Here, the curvature radius in the section was recorded in a photograph using an optical microscope with a magnification of 100. The background and the substrate were separated by image processing to make the value binary, the bottom surface (the contacting surface) and the side surface regions were removed (trimmed), an arc was fitted as the model shape, and the radius of the curvature was found.

In the following, the procedure of forming the low resistance film using the emission method is described with reference to FIGS. 2A to 2E. In the figures, reference numeral 101 denotes a spacer substrate shown from the side of a side surface and an end surface. Before the emitting step, first, chemical cleaning was carried out using acetone, IPA, and pure water, and after that, drying at 80° C. for 30 minutes was carried out, and then, UV ozone cleaning was carried out to remove residual organic matter on the surface of the substrate.

Figure 2A:
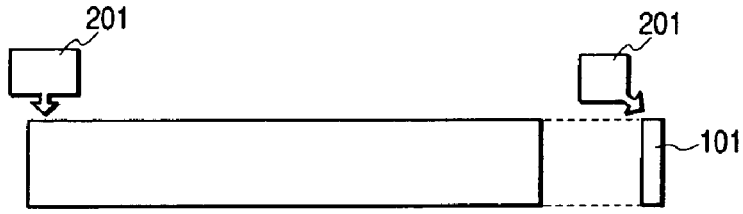
FIGS. 2A, 2B, 2C, 2D, and 2E are explanatory views of the manufacturing steps of a spacer of an embodiment according to the present invention.
Figure 2B:
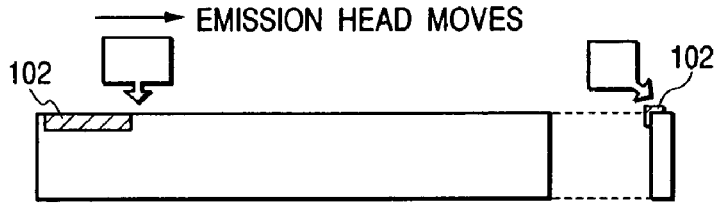
Figure 2C:
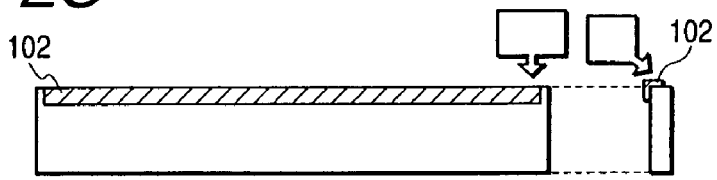

Using a bubble jet type ink-jet firing device 201 as the liquid drop applying device, liquid drops of a solution containing organic palladium (CCP-4230 manufactured by Okuno Chemical Industries Co., Ltd.) were applied at a substrate edge portion where a side surface (a surface of 40 mm×3 mm) and a bottom surface (a surface of 40 mm×0.2 mm) of the spacer substrate g1 intersected each other, at an angle of 45° with regard to both the bottom surface and the side surface, such that the width of the low resistance film 102 was 400 μm and the thickness of the low resistance film 102 was 1000 Å on the substrate g1 (FIGS. 2A, 2B, and 2C).

Figure 2D:
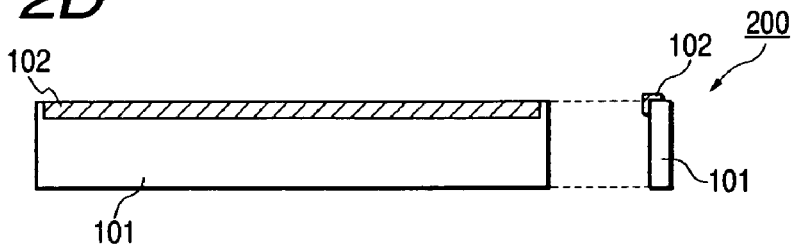

Here, the low resistance film 102 was formed with regard to the above-mentioned edge, with the amount of above-mentioned liquid drop (one dot) being 60 $\mu m^3$ and the application of liquid drops being carried out ten times for forming the portion of the low resistance film (FIG. 2D).

Figure 1A:
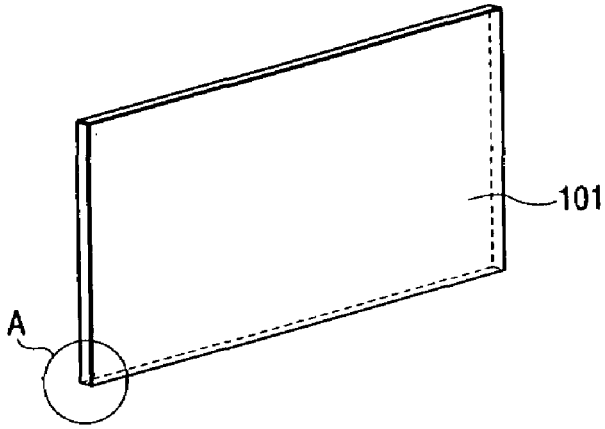
FIGS. 1A, 1B, 1C, 1D, and 1E are schematic views of a spacer substrate of an embodiment according to the present invention.
Figure 1B:
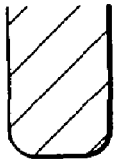
Figure 1C:
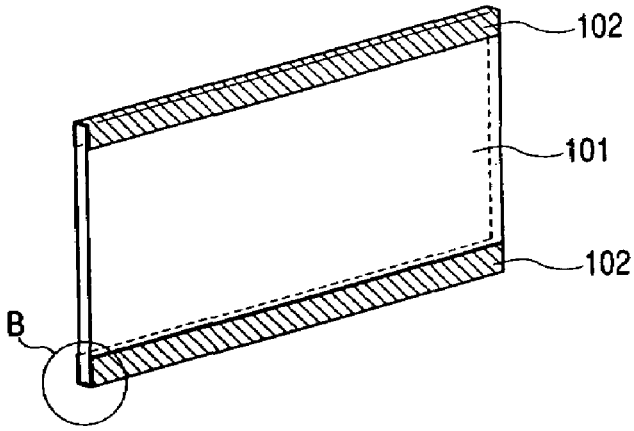
Figure 1D:
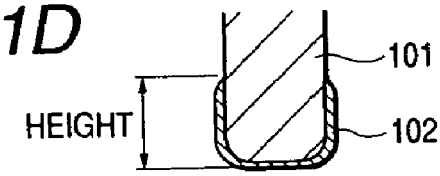
Figure 1E:
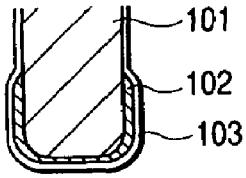
Figure 2E:
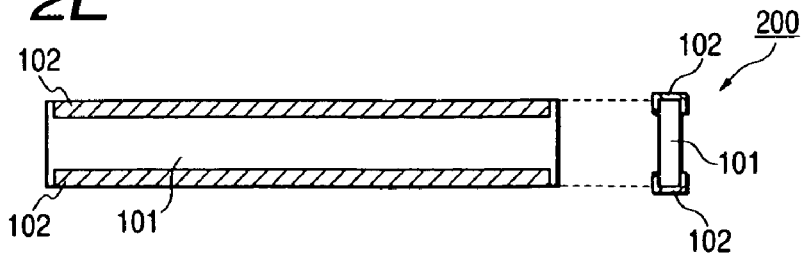

After the series of liquid emissions were carried out also with regard to the other three edges in parallel with the edge, drying was carried out at 120° C. for ten minutes and heating was carried out at 300° C. for ten minutes to form the low resistance films 102 of palladium oxide (PdO) particles on the upper and lower bottom surfaces as shown in FIG. 1C, and a spacer 200 with the low resistance film was obtained (FIG. 2E). This is referred to as spacer A. Here, the shape in section in the vicinity of the junction portion is shown in FIG. 1D, and the height of each low resistance film was 200 μm. The thickness of each of the low resistance film 102 was 1000 Å, and the surface resistance was $10^3$ Ω/□. Then, as an antistatic film (high resistance film 103), by simultaneously sputtering targets of Cr and Al with a high-frequency power source, a Cr—Al alloy nitride film was formed at the thickness of 200 nm on the surface of the substrate. The sputtering gas was a mixed gas with $Ar:N_2=1:2$, and the total pressure was about $1.3\times10^{-1}$ Pa. The surface resistance of the simultaneously formed film on the above conditions was $2\times10^9$ Ω/□. Here, the shape in section in the vicinity of the junction portion is shown in FIG. 1E.

Specular reflection was observed at the obtained low resistance film portion of spacer A. In addition, no partial "peeling off" phenomenon and the like were observed at the interface region between the bottom surface and the side surface, i.e., the edge portion, and the coating of the film was sufficient.

In the present embodiment, a display panel having the above-mentioned spacers 1020 shown in FIG. 9 disposed therein was formed using spacer A, which is described in detail in the following with reference to FIGS. 9 and 15.

First, the row direction wiring electrodes 1013, the column direction wiring electrodes 1014, the insulating layer (not shown) between electrodes, and the substrate 1011 having the device electrodes and conductive thin films of the surface conduction electron-emitting devices formed thereon were fixed to the rear plate 1015 in advance. Then, the spacers A as the spacers 1020 were fixed on the row direction wirings 1013 of the substrate 1011 at equal intervals in parallel with the row direction wirings 1013.

After that, the face plate 1017, having the fluorescent film 1018 and the metal back 1019 provided on the inner surface thereof, was disposed 5 mm above the substrate 1011 through the side walls 1016, and the junction portions of the rear plate 1015, the face plate 1017, the side walls 1016, and the spacers 1020 were fixed.

The junction portion between the substrate 1011 and the rear plate 1015, the junction portion between the rear plate 1015 and the side walls 1016, and the junction portion between the face plate 1017 and the side walls 1016 were sealed by applying frit glass (not shown) and baking in the atmosphere at 400–500° C. for ten minutes or more. The bonding and electrical connection of the spacers 1020 were carried out by disposing them on the row direction wirings 1013 (pitch: 300 μm) on the side of the substrate 1011 and on the surface of the metal back 1019 on the side of the face plate 1017 through conductive frit glass (not shown) with conductive filler or a conductor such as a metal mixed therewith and baking in the atmosphere at 400 to 500° C. for ten minutes or more simultaneously with the sealing of the airtight container.

Figure 14:
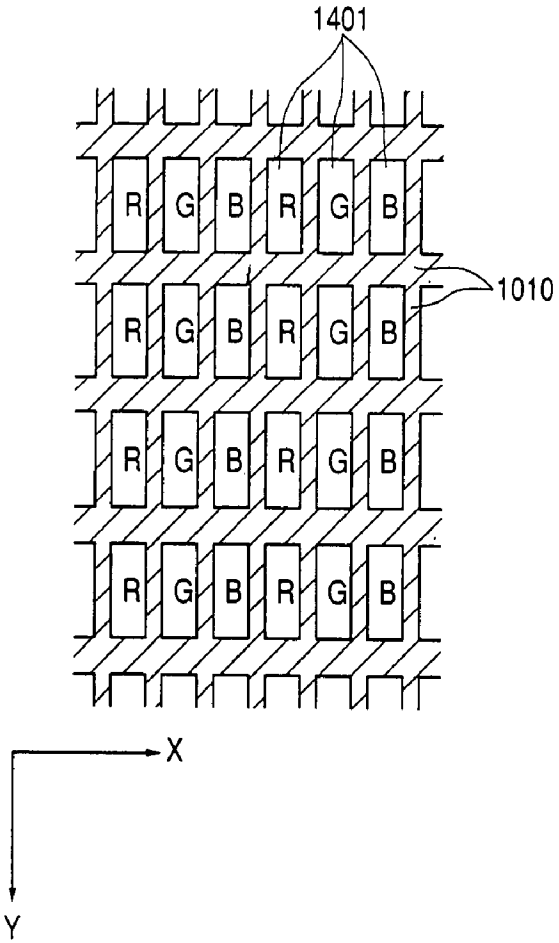
FIG. 14 is a view showing another example of the arrangement of phosphors on the face plate of the display panel.

It is to be noted that, in the present embodiment, in the fluorescent film 1018, as shown in FIG. 14, a stripe-like shape was adopted where the phosphors 1401 in the three colors extend in the column direction (Y direction), and the black conductor 1010 was disposed so as to separate not only the phosphors 1401 in the three colors (R, G, and B) but also the respective pixels in the Y direction. The spacers 1020 were disposed within the regions of the black conductor 1010, which were in parallel with the row direction (X direction) (pitch: 300 μm) through the metal back 1019.

It is to be noted that, in carrying out the above-described sealing, since it is necessary to make the phosphors 1401 in the three colors correspond to the respective electron-emitting devices 1012 disposed on the substrate 1011, sufficient alignment of the rear plate 1015, the face plate 1017, and the spacers 1020 was carried out.

The inside of the airtight container constructed as described above was vacuumed with a vacuum pump through an exhaust pipe (not shown). After the vacuum reached a sufficient level, power was supplied through terminals Dx1 to Dxm and Dy1 to Dyn outside the container to the respective devices through the row direction wirings 1013 and the column direction wirings 1014 to carry out the above-described energization forming operation and energization activation operation to manufacture the multiple electron beam source. Then, the exhaust pipe (not shown) was melted by being heated with a gas burner with the vacuum being about $10^{-4}$ Pa to seal the envelope (airtight container). Finally, in order to maintain the vacuum after the sealing, gettering was carried out.

In an image display device using the display panel constructed in this way and shown in FIGS. 9 and 15, by applying a scanning signal and a modulation signal from a signal generating means (not shown) to the respective cold cathode devices (surface conduction electron-emitting devices) 1012 through the terminals Dx1 to Dxm and Dy1 to Dyn outside the container, electron emission was caused. High voltage was applied to the metal back 1019 through the high voltage terminal Hv to accelerate the emitted electron beams. The accelerated electrons impacted the fluorescent film 1018 to excite the phosphors 1401 in the three colors (R, G, and B in FIG. 14) and caused light emission, and an image was displayed. It is to be noted that the voltage Va applied to the high voltage terminal Hv was in the range of 3 kV to 12 kV, and applied to the critical voltage where discharge was gradually caused, and the voltage Vf applied between the respective wirings 1013 and 1014 was 14V. When 8 kV or higher voltage was applied to the high voltage terminal Hv and continuous driving for one hour or more was possible, it was judged that the withstand voltage was sufficient.

Here, in the vicinity of spacer A, the withstand voltage was sufficient. Further, including light emission spots due to electrons emitted from cold cathode devices 1012 near spacer A, two-dimensional light emission spot rows were formed at equal intervals, and vivid color image display with sufficient color reproducibility could be carried out. This means that, even though spacer A was disposed, turbulence in the electric field, which influences the electron trajectory, was not caused.

It is to be noted that, in the present embodiment, by using the emission method in which liquid drops are applied to form the low resistance film of spacer A, since it is possible to form the low resistance film only in a region where a pattern is formed without additional pattern forming only in the vicinity of the junction portions of the spacer substrate, the raw material solution can be saved, and thus, there is an advantage with regard to the cost.

Embodiment 2

Piezo-Electric Device Emission Type

Figure 6A:
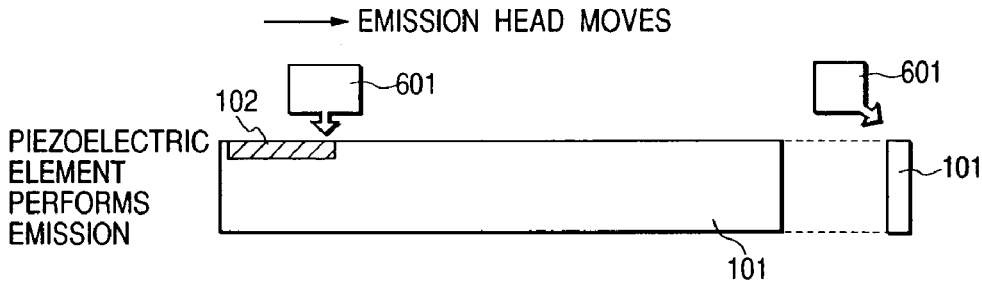
FIGS. 6A, 6B, and 6C are explanatory views of a solution emitting device used in Embodiments 2, 4, and 5 according to the present invention.

Using the spacer substrate g1 used in Embodiment 1, and except that a piezo-electric type ink-jet firing device 601 (see FIG. 6A) was used as the liquid drop applying device, in the same way as the forming method of Embodiment 1, the low resistance film 102 at the height of 200 μm was formed. Further, in the same way as in Embodiment 1, a high resistance film was formed by sputtering. This is referred to as spacer B. Specular reflection was observed at the obtained low resistance film portion of spacer B. In addition, no partial peeling off and the like were observed at the interface region between the bottom surface and the side surface, i.e., the edge portion, and the coating of the film was sufficient.

Further, in the same way as in Embodiment 1, an electron beam emitting apparatus (FIG. 9) was formed together with a rear plate having electron-emitting devices incorporated therein and the like, and high voltage application and device driving were carried out under the same conditions as those in Embodiment 1.

Here, in the vicinity of spacer B, the withstand voltage was sufficient. Further, two-dimensional light emission spot rows were formed at equal intervals including light emission spots due to electrons emitted from the cold cathode devices 1012 near spacer B, and vivid color image display with sufficient color reproducibility could be carried out. This means that, even though spacer B was disposed, turbulence in the electric field, which influences the electron trajectory, was not caused.

Embodiment 3

Airbrush Type

Using the spacer substrate g1 used in Embodiment 1, and except that an airbrush-type ink-jet firing device (not shown) was used as the liquid drop applying device, in the same way as the forming method of Embodiment 1, a low resistance film at the height of 200 μm was formed. It is to be noted that, in the airbrush-type ink-jet firing device, a shutter and a slit were provided on the front surface of an emission nozzle to restrict the sprayed region. Further, in the same way as in Embodiment 1, a high resistance film was formed by sputtering. This is referred to as spacer C. Specular reflection was observed at the obtained low resistance film portion of spacer C. In addition, no partial peeling off and the like were observed at the interface region between the bottom surface and the side surface, i.e., the edge portion and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer C, the withstand voltage was sufficient. Further, including light emission spots due to electrons emitted from the cold cathode devices 1012 near spacer C, two-dimensional light emission spot rows were formed at equal intervals, and vivid color image display with sufficient color reproducibility could be carried out. This means that, even though spacer C was disposed, turbulence in the electric field, which influences the electron trajectory was not caused.

Embodiment 4

Multiple Nozzle Piezo-Electric Type

Figure 6B:
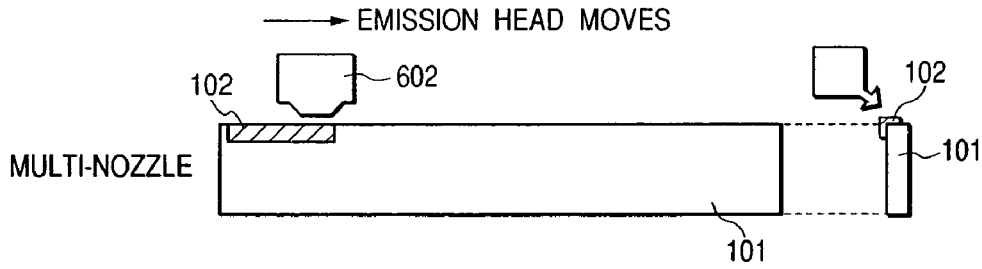

Using the spacer substrate g1 used in Embodiment 1, and except that a piezo-electric-type ink-jet firing device 602 (see FIG. 6B) comprising ten ink nozzles in series was used as the liquid drop applying device and the coating was carried out once at each of the edges, in the same way as the forming method of Embodiment 1, a low resistance film at the height of 200 μm was formed. Further, in the same way as in Embodiment 1, a high resistance film was formed by sputtering. This is referred to as spacer D. Specular reflection was observed at the obtained low resistance film portion of spacer D. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer D, the withstand voltage was sufficient. Further, including light emission spots due to electrons emitted from the cold cathode devices 1012 near spacer D, two-dimensional light emission spot rows were formed at equal intervals, and vivid color image display with sufficient color reproducibility could be carried out. This means that, even though spacer D was disposed, turbulence in the electric field, which influences the electron trajectory, was not caused.

Embodiment 5

Figure 6C:
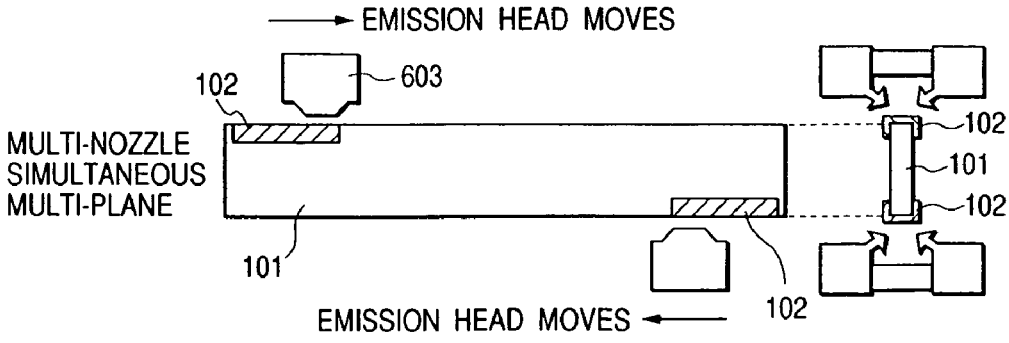

Multiple Nozzle Piezo-Electric-Type Simultaneous Emission to a Plurality of Directions Using the spacer substrate g1 used in Embodiment 1, and except that an emission device 603 (see FIG. 6C) simultaneously using four piezo-electric-type ink-jet firing devices each comprising ten ink nozzles in series was used as the liquid drop applying device, the firing was carried out simultaneously from the four directions, the coating was carried out once at each of the edges, and the four edges were simultaneously formed, in the same way as the forming method of Embodiment 1, a low resistance film at the height of 200 μm was formed. Further, in the same way as in Embodiment 1, a high resistance film was formed by sputtering. This is referred to as spacer E. Specular reflection was observed at the obtained low resistance film portion of spacer E. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer E, the withstand voltage was sufficient. Further, including light emission spots due to electrons emitted from the cold cathode devices 1012 near spacer E, two-dimensional light emission spot rows were formed at equal intervals, and vivid color image display with sufficient color reproducibility could be carried out. This means that, even though spacer E was disposed, turbulence in the electric field, which influences the electron trajectory, was not caused.

Embodiment 6

Thermal Energy Type Using Palladium Acetate as Emission Material

Using the spacer substrate g1 used in Embodiment 1, and except that, as the coating solution, an organic palladium solution containing 0.05 wt % dissolved in water (palladium acetate-monoethanolamine complex 0.66 wt % (palladium component amount: 0.15 wt %), isopropyl alcohol 15 wt %, water 83.29 wt %, ethylene glycol 1 wt %, and PVA 0.05 wt %) was used, in the same way as the forming method of Embodiment 1, a low resistance film was formed on the spacer. Further, in the same way as in Embodiment 1, a high resistance film was formed on the spacer by sputtering. This is referred to as spacer F. Specular reflection was observed at the obtained low resistance film portion of spacer F. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer F, the withstand voltage was sufficient. Further, including light emission spots due to electrons emitted from the cold cathode devices 1012 near spacer F, two-dimensional light emission spot rows were formed at equal intervals, and vivid color image display with sufficient color reproducibility could be carried out. This means that, even though spacer F was disposed, turbulence in the electric field, which influences the electron trajectory, was not caused.

Embodiment 7

Thermal Energy Type with Spacer Having Minuter R

A base material formed of soda lime glass, which is the same material as that of the rear plate, was processed using hot-draw, and pillar-like glass was formed having the following dimensions in section: 3 mm in width; 0.2 mm in thickness; and 4 μm in curvature radius at the four vertexes. The glass was cut to have the length of 40 mm to obtain a spacer substrate g2. After that, in the same way as the forming method of Embodiment 1, a low resistance film at the height of 200 μm was formed. Further, in the same way as in Embodiment 1, a high resistance film was formed by sputtering. This is referred to as spacer G. Specular reflection was observed at the obtained low resistance film portion of spacer G. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer G, the withstand voltage was also sufficient. Further, including light emission spots due to electrons emitted from the cold cathode devices 1012 near spacer G, two-dimensional light emission spot rows were formed at equal intervals, and vivid color image display with sufficient color reproducibility could be carried out. This means that, even though spacer G was disposed, turbulence in the electric field, which influences the electron trajectory, was not caused.

Embodiment 8

Thermal Energy Type with Spacer Formed of Alumina

An alumina substrate the interfaces between the bottom surface and the side surfaces, i.e., the bottom surface edges, of which were tapered to have the angle of 45° with regard to the region of 10 μm from the edges by grinding was used as a spacer substrate a1. In the same way as the forming method of Embodiment 1, a low resistance film at the height of 200 μm was formed on the substrate a1. Further, in the same way as in Embodiment 1, a high resistance film was formed by sputtering. This is referred to as spacer H. Specular reflection was observed at the obtained low resistance film portion of spacer H. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer H, the withstand voltage was also sufficient. Further, including light emission spots due to electrons emitted from the cold cathode devices 1012 near spacer H, two-dimensional light emission spot rows were formed at equal intervals, and vivid color image display with sufficient color reproducibility could be carried out. This means that, even though spacer H was disposed, turbulence in the electric field, which influences the electron trajectory, was not caused.

Embodiment 9

Thermal Energy Type with Spacer Being Tapered

A soda lime glass substrate having the interfaces between the bottom surface and the side surfaces, i.e., the bottom surface edges, of which were tapered to have the angle of 45° with regard to the region of 10 μm from the edges by grinding was used as a spacer substrate g3. In the same way as the forming method of Embodiment 1, a low resistance film at the height of 200 μm was formed on the substrate g3. Further, in the same way as in Embodiment 1, a high resistance film was formed by sputtering. This is referred to as spacer I. Specular reflection was observed at the obtained low resistance film portion of spacer I. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer 1, the withstand voltage was also sufficient. Further, including light emission spots due to electrons emitted from the cold cathode devices 1012 near spacer I, two-dimensional light emission spot rows were formed at equal intervals, and vivid color image display with sufficient color reproducibility could be carried out. This means that, even though spacer I was disposed, turbulence in the electric field, which influences the electron trajectory, was not caused.

Embodiment 10

Thermal Energy Type with Spacer Being Orthogonally Ground

A soda lime glass substrate the whole six surfaces of which including the interfaces between the bottom surface and the side surfaces, i.e., the bottom surface edges, were ground to be orthogonally disposed with respect to one another by grinding was used as a spacer substrate g4. In the same way as the forming method of Embodiment 1, a low resistance film at the height of 200 μm was formed on the substrate g4. Further, in the same way as in Embodiment 1, a high resistance film was formed by sputtering. This is referred to as spacer J. Specular reflection was observed at the thus obtained low resistance film portion of spacer J. In addition, three partial peeling off places were observed with regard to one 40 mm-long edge at the interface region between the bottom surface and the side surface, i.e., the edge portion, and the coating of the film was partially insufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer J, the withstand voltage was also sufficient. Further, including light emission spots due to electrons emitted from the cold cathode devices 1012 near the spacer J, two-dimensional light emission spot rows were formed at equal intervals, and vivid color image display with sufficient color reproducibility could be carried out. This means that, even though spacer J was disposed, turbulence in the electric field, which influences the electron trajectory, was not caused. The reason why, although the rate of coating at the edges was partially insufficient, no turbulence was observed in the light emission spots is thought to be that, since almost all of the remaining low resistance film portion contacted sufficiently, the common electric potential at the upper end of the lower resistance film was maintained.

Embodiment 11

Thermal Energy Type with Spacer Formed of Glass Fiber

A glass fiber substrate with the diameter of 400 μm and the height of 3 mm, having the interfaces between the bottom surface and the side surfaces, i.e., the bottom surface edges, which were tapered to have the angle of 45° with regard to the region of 10 μm from the edges by grinding, was used as a spacer substrate g5. Except that the substrate g5 was rotated about the draw axis of the fiber and the emission head was fixed, in the same way as the forming method of Embodiment 1, a low resistance film at the height of 200 μm was formed. Further, in the same way as in Embodiment 1, a high resistance film was formed by sputtering. This is referred to as spacer K. Specular reflection was observed at the thus obtained low resistance film portion of spacer K. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer K, withstand voltage was also sufficient. Further, including light emission spots due to electrons emitted from the cold cathode devices 1012 near spacer K, two-dimensional light emission spot rows were formed at equal intervals, and vivid color image display with sufficient color reproducibility could be carried out. This means that, even though spacer K was disposed, turbulence in the electric field, which influences the electron trajectory, was not caused.

Embodiment 12

Thermal Energy Type Using Pt Complex as Emission Material and Using Ladder-like Arranged Electron Source Using the spacer substrate g1 used in Embodiment 1, and except that an organic platinum solution (platinum acetate-monoethanolamine complex 1.14 wt % (platinum component amount: 0.4 wt %), isopropyl alcohol 20 wt %, water 77.81 wt %, ethylene glycol 1 wt %, and PVA 0.05 wt %) was used as the coating solution, and the baking/drying temperature was 350° C., in the same way as the forming method of Embodiment 1, a low resistance film was formed on the spacer. Further, in the same way as in Embodiment 1, a high resistance film was formed on the spacer by sputtering. This is referred to as spacer L. Specular reflection was observed at the obtained low resistance film portion of spacer L. In addition, no partial peeling off and the like were observed at the interface region between the bottom surface and the side surface, i.e., the edge portion, and the coating of the film was sufficient.

Further, except that a ladder-like arranged electron source was used as the electron source substrate and grid electrodes were disposed, in the same way as in Embodiment 1, with a rear plate having electron-emitting devices incorporated therein and the like, an electron beam emitting apparatus (FIG. 25) was formed, and high voltage application and device driving was carried out under the same conditions as those in Embodiment 1.

Here, in the vicinity of spacer L, the withstand voltage was sufficient. Further, including light emission spots due to electrons emitted from the cold cathode devices 1111 near spacer L, two-dimensional light emission spot rows were formed at equal intervals, and vivid color image display with sufficient color reproducibility could be carried out. This means that, even though spacer L was disposed, turbulence in the electric field, which influences the electron trajectory, was not caused.

Embodiment 13

A spacer N used in the present embodiment was formed as follows.

Figure 30:
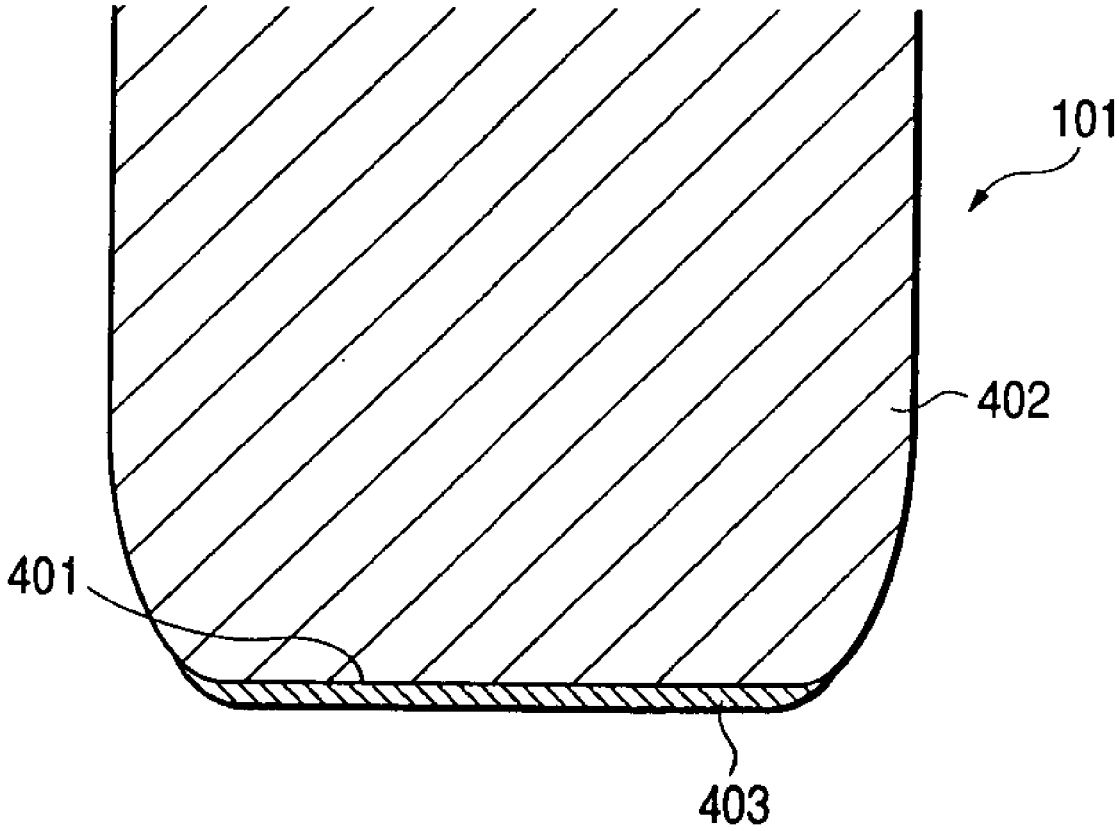
FIG. 30 is an explanatory view of the shape in section in the vicinity of the junction portion of a spacer according to Embodiment 13 of the present invention.

Except that the coating step was carried out only with regard to the bottom surface (the contacting surface), including that the spacer substrate g1 was used, the formation was carried out under the same conditions as those in Embodiment 1. In the same way as in Embodiment 1, a high resistance film was formed on the obtained spacer with the low resistance film. This is referred to as spacer N. Specular reflection was observed at the obtained low resistance film portion of spacer N. In addition, no partial wraparound to the side surfaces, waves, and peeling off were observed, and the coating was sufficient. FIG. 30 is a sectional view in the vicinity of the bottom surface (the contacting surface, end surface) after the low resistance film was formed.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment 1.

Here, in the vicinity of spacer N, the withstand voltage was sufficient. Further, including light emission spots due to electrons emitted from the cold cathode devices 1012 near spacer N, two-dimensional light emission spot rows were formed at equal intervals, and vivid color image display with sufficient color reproducibility could be carried out.

This means that, even though spacer N was disposed, turbulence in the electric field, which influences the electron trajectory, was not caused.

Comparative Example

Spacer of a Vapor Phase Forming Method

Figure 8A:
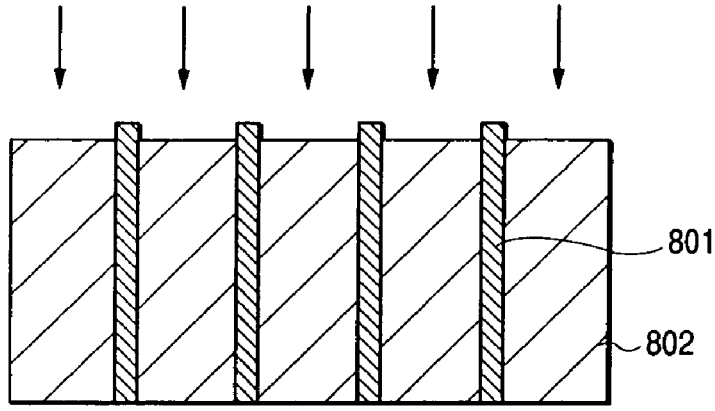
FIGS. 8A, 8B, 8C, and 8D are views for explaining the manufacturing steps of a vapor phase low resistance film for comparison.
Figure 8B:
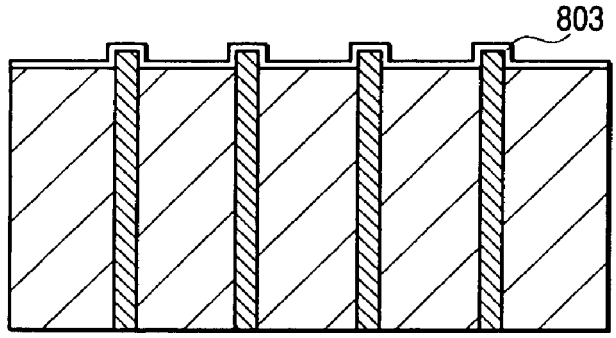
Figure 8C:
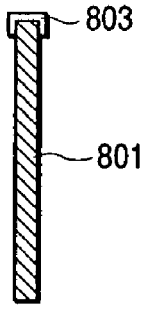
Figure 8D:
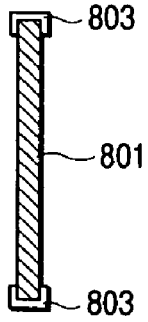

The spacer substrate g1 used in Embodiment 1 was used. As the low resistance film, at the junction portions with the face plate and the rear plate, rectangular-parallelepiped fixtures 802 made of glass and 2.8 mm in height, 42 mm in width, and 1.1 mm in depth were disposed in parallel with the junction portions and alternately with the above-mentioned spacer substrates g1 (801 in the figure), which were 3 mm in height, as shown in FIGS. 8A and 8B. Then, as shown in FIG. 8C, a Ti film with a thickness of 10 nm and then a Pt film with the thickness of 200 nm (803 in the figure) were formed so as to provide a strip, which is 200 μm wide, by sputtering using the vapor phase forming method. It is to be noted that the sputtering film-forming step was carried out twice, i.e., with regard to the upper bottom surface side and the lower bottom surface side, and the formation was as shown in FIG. 8D. Here, the Ti film was necessary as an underlayer for reinforcing the film adhesion of the Pt film. After that, in the same way as in Embodiment 1, a high resistance film was formed by sputtering. This is referred to as spacer M. Here, specular reflection was observed at the obtained low resistance film portion of spacer M. In addition, no partial peeling off and the like were observed at the interface region between the bottom surface and the side surface, i.e., the edge portion, and the coating of the film was sufficient.

Further, in the same way as in Embodiment 1, with a rear plate having electron-emitting devices incorporated therein and the like, an electron beam emitting apparatus (FIG. 9) was formed, and high voltage application and device driving were carried out under the same conditions as those in Embodiment I.

Here, in the vicinity of spacer M, the withstand voltage was also sufficient, but partially, a minute discharge was found. It is to be noted that, including light emission spots due to electrons emitted from the cold cathode devices 1012 near spacer M, two-dimensional light emission spot rows were formed at equal intervals, and vivid color image display with sufficient color reproducibility could be carried out. This means that, even though spacer M was disposed, turbulence in the electric field, which influences the electron trajectory, was not caused.

Comparison was made among samples A to L and N with the low resistance film formed according to the present invention and sample M of the comparative example with regard to the method of forming, electrical contact, light emission spot shift, and anode withstand voltage. With regard to all of samples A to L and N and sample M, the electrical contact, light emission spot shift, and withstand voltage as the panel characteristics were sufficient, and a low resistance film appropriate for a spacer for withstanding the vacuum for an electron emission panel could be formed.

However, compared with sample M, samples A to L and N have advantages with regard to the cost of the manufacturing process, because the film-forming apparatus does not require an expensive vacuuming apparatus, high efficiency associated with the use of the material, and the like. Further, with regard to sample M, from the viewpoint of the adhesion of the Pt film, formed by sputtering on the glass substrate, the process of providing the underlayer between the Pt film and the substrate is necessary. However, according to the present invention, this can be eliminated, and thus, the present invention is advantageous.

Further, compared with the low resistance film formed by emission described in the embodiments of the present invention, in the film formation by sputtering, a minute discharge was caused in the electron source substrate and the anode substrate to an extent that the electron-emitting device is not broken. The reason for this is thought to be that, while the film formed by the emission becomes thinner on the periphery and tapered in section, in the film formation by sputtering, the edges of the film at the end of the patterning have an orthogonal surface in section, or protrusions such as burrs are formed toward the space outside the spacer when the spacer is peeled from the mask, and thus, the electric field is likely to concentrate on these protrusions in the electron beam apparatus.

It is to be noted that, with regard to sample J of Embodiment 10, although the withstand voltage and the beam light emission position were as sufficient as those of the samples of the other embodiments, it was found that the rate of coating of the low resistance film is low at the substrate edge portions. It can be seen that, taking into consideration the yield in mass production and the like, to round the substrate edges it is more preferable to improve the rate of coating.

uAccording to the invention of the present application, a film can be appropriately formed on spacers or minute members provided in an airtight container.

What is claimed is:

1. A method of manufacturing a spacer for use in an electron beam apparatus having an airtight container with electron-emitting devices contained therein and spacers provided in the airtight container, the method comprising:

preparing a spacer substrate having a portion, which is treated so that substantially no acute angle in a cross-section is provided at a corner portion between a first surface, which is flat, and a second surface, wherein the first surface faces a substrate of the container and the second surface is a side surface to the first surface when the spacer is arranged in the container; and applying a liquid material for a film to at least a part of the corner portion of the spacer substrate from a nozzle by a bubble generated using thermal energy, or by a piezoelectric element, wherein the spacer substrate is such that the following relationship is satisfied:

$$(t^2+4h^2)<s^2<(t+2h)^2,$$

wherein t is a maximum value of a thickness of the spacer substrate when the film is formed from the liquid material, h is a height of the film, and s is an inner peripheral length of a section of the film.

2. The method according to claim 1, further comprising a moving step of changing a relative poison of the nozzle and the spacer substrate.

3. The method according to claim 1, wherein the applying step includes a step of emitting a droplet of the liquid material from a single nozzle.

4. The method according to claim 1, wherein the liquid material is emitted from the nozzle by generating the bubble in the liquid material before the emission.

5. The method according to claim 1, wherein in the liquid material is emitted by a piezoelectric element.

6. The method according to claim 1, wherein the liquid material comprises a metal element.

7. The method according to claim 1, wherein the film is an electrode.

8. The method according to claim 1, wherein the liquid material is applied from a plurality of nozzles.

9. The method according to claim 1, wherein the liquid material is applied simultaneously to the first surface and the second surface of the spacer substrate.

10. The method according to claim 1, wherein the spacer substrate is processed using hot-draw, which is carried out with relationship $S_2>S_1$ being satisfied, where $S_1$ is a cross-section of a desired spacer substrate and $S_2$ is a cross-section of a spacer base material, with both ends of a spacer base material being fixed, a cross-section of the spacer base material being similar in shape to that of the spacer substrate, a part of the spacer base material in a longitudinal direction being heated to a temperature at or above a softening point while one end portion is fed in a direction of the heated portion at a velocity of $V_1$ and the other end portion is drawn in the same direction as that of $V_1$ at a velocity of $V_2$, and a relationship $S_1/S_2=V_1/V_2$ being satisfied, and wherein the spacer base material is cooled after the hot-drawn spacer base material is cut to have a desired length.

11. The method according to claim 1, wherein the spacer substrate is formed of glass or ceramic.

12. A method of manufacturing an electron beam apparatus having an airtight container with electron-emitting devices contained therein and the spacers provided in said airtight container, wherein the spacer is manufactured according to claim 1.

13. The method according to claim 1, wherein the liquid material is sprayed.

14. The method according to claim 13, wherein a part of the sprayed liquid material does not reach the treated portion of the spacer substrate.

15. The method according to claim 1, wherein the spacer substrate is treated by rounding or tapering the corner portion between the first surface and the second surface of the spacer substrate.

16. The method according to claim 15, wherein the rounding of the spacer substrate is carried out such that a radius r of a curvature is 1% or more of a maximum value t of a thickness of the spacer substrate where the film is formed.

17. The method according to claim 1, wherein a high resistance film having a surface resistance of at least $10^5$ Ω/square is formed on the spacer having the film formed thereon.

18. The method according to claim 17, wherein the liquid material is applied to a part of a treated area.

19. The method according to claim 17, wherein the high resistance film has a surface resistance value of $10^5$–$10^{12}$ Ω/square.

20. The method according to claim 19, wherein the film has a surface resistance value of 1/10 or less of that of the high resistance film, and less than $10^7$ Ω/square.

21. The method according to claim 1, wherein the liquid material is applied drop by drop.

22. The method according to claim 21, wherein the liquid material is applied from a plurality of nozzles each emitting the liquid material drop by drop.

* * * * *

UNITED STATES PATENT AND TRADEMARK OFFICE

CERTIFICATE OF CORRECTION

PATENT NO. : 7,067,171 B2
APPLICATION NO. : 09/505627
DATED : June 27, 2006
INVENTOR(S) : Nobuhiro Ito It is certified that error appears in the above-identified patent and that said Letters Patent is hereby corrected as shown below:

COLUMN 1

Line 23, “““MIM type”).” should read --“MIM type”).--.

COLUMN 4

Line 11, “110 Pa.” should read --$10^{-4}$ Pa.--.

COLUMN 13

Line 23, “nitride” should read --nitrides--..

COLUMN 14

Line 20, “the” should read --a--.

COLUMN 17

Line 8, “even the” should read --even if the--.

COLUMN 20

Line 50, “DX1” should read --Dx1--.

COLUMN 23

Line 26, “the” (second occurrence) should be deleted.

COLUMN 27

Line 20, “device-” should read --device--.

COLUMN 30

Line 26, “line memory 115” should read --line memory 1705--.

UNITED STATES PATENT AND TRADEMARK OFFICE

CERTIFICATE OF CORRECTION

PATENT NO. : 7,067,171 B2
APPLICATION NO. : 09/505627
DATED : June 27, 2006
INVENTOR(S) : Nobuhiro Ito It is certified that error appears in the above-identified patent and that said Letters Patent is hereby corrected as shown below:

COLUMN 36

Line 8, “trajectory” should read --trajectory,--.

COLUMN 42

Line 14, “Embodiment I.” should read --Embodiment 1.--.

COLUMN 43

Line 1, “uAccording” should read --According--;
Line 28, “poison” should read --position--; and
Line 36, “in” should be deleted.

Signed and Sealed this

Sixteenth Day of January, 2007

JON W. DUDAS
*Director of the United States Patent and Trademark Office*